US009487281B2

(12) United States Patent
Wolfenbarger

(10) Patent No.: US 9,487,281 B2
(45) Date of Patent: Nov. 8, 2016

(54) SUBMERSIBLE REMOTELY OPERATED VEHICLE

(71) Applicant: Daniel Wolfenbarger, Zolfo Springs, FL (US)

(72) Inventor: Daniel Wolfenbarger, Zolfo Springs, FL (US)

( * ) Notice: Subject to any disclaimer, the term of this patent is extended or adjusted under 35 U.S.C. 154(b) by 187 days.

(21) Appl. No.: 14/569,744

(22) Filed: Dec. 14, 2014

(65) Prior Publication Data

US 2016/0167756 A1 Jun. 16, 2016

(51) Int. Cl.

| | |
|---|---|
| ***B63G 8/00*** | (2006.01) |
| ***B63H 5/125*** | (2006.01) |
| ***B63G 8/38*** | (2006.01) |
| ***H04R 1/44*** | (2006.01) |

(52) U.S. Cl.

CPC ..... *B63G 8/001* (2013.01); *B63G 8/38* (2013.01); *B63H 5/125* (2013.01); *H04R 1/44* (2013.01); *B63G 2008/007* (2013.01); *B63H 2005/1258* (2013.01); *H04R 2499/13* (2013.01)

(58) Field of Classification Search

CPC .. B63G 8/001; B63G 8/08; B63G 2008/007; B63G 8/16; B63C 11/42

See application file for complete search history.

(56) References Cited

U.S. PATENT DOCUMENTS

| | | | | |
|---|---|---|---|---|
| 3,521,589 | A * | 7/1970 | Kemp | B63G 8/16 114/330 |
| 3,752,103 | A * | 8/1973 | Middleton | B63G 8/16 114/332 |
| 3,949,694 | A * | 4/1976 | Bastide | B63C 11/42 114/313 |
| 4,821,665 | A | 4/1989 | Matthias et al. | |
| 5,039,254 | A | 8/1991 | Piercy | |
| 6,711,095 | B1 | 3/2004 | Daniels | |
| 8,162,061 | B2 | 4/2012 | Maxwell | |
| 2010/0212573 | A1 | 8/2010 | Hawkes et al. | |
| 2010/0212574 | A1 | 8/2010 | Hawkes et al. | |

* cited by examiner

*Primary Examiner* — Edwin Swinehart

(74) *Attorney, Agent, or Firm* — Lonnie R. Drayer

(57) ABSTRACT

A submersible ROV is provided with four independently controllable swivel thruster assemblies that allow the submersible ROV to simulate the movement of a person equipped with scuba gear. The submersible ROV receives control signals from a controller located on the surface of the water or on land. The submersible ROV senses and transmits audio and visual images and transmits those signals to a base receiver located on the surface of the water or on land. Signals are transmitted to and from the submersible ROV via a tether. The tether may be connected either directly to the controller/base receiver or may be connected to an intermediate floating ROV with a power supply and wireless communication relay station. A person can vicariously experience scuba diving via the submersible ROV while remaining dry and safe on land or on a surface vehicle.

20 Claims, 37 Drawing Sheets

50a 92
50a

92

50a
92

50a
92
50a 92
50a

92

50a
92
50a

92

SUBMERSIBLE REMOTELY OPERATED VEHICLE

FIELD OF THE INVENTION

The present invention relates to a submersible remotely operated vehicle (ROV) that emulates the motion and vision of a human scuba diver.

BACKGROUND OF THE INVENTION

Submersible remotely operated vehicles (ROVs) of the prior art are designed to provide a stable platform for obtaining images and manipulating tools for grasping or otherwise interacting with submerged items such as sunken vessels or relics. It is understood that a person provided with scuba gear is not a stable platform, but rather is subject to motion in multiple axes due to the slightest movement of the arms and legs of the person. Many people are physically unable, or chose not to participate in the activity of scuba diving. It is believed that many of those same people would like to have the experience of viewing submersed objects in the same manner as a person that is participating in the activity of scuba diving. There is a need for a device that will simulate the unstable movements of a person participating in scuba diving to allow a person that is not in the water to remotely control a submersible device and be provided with images simulating what a person sees when scuba diving in real time.

DISCUSSION OF THE PRIOR ART

U.S. Pat. No. 4,821,665 A teaches a submersible ROV that removes extraneous material from the surface of submerged metal with a cleaning tool and measures the thickness of the metal with an ultrasonic probe. A camera allows visual operation of the ROV. The cleaning tool and ultrasonic probe can reach areas of limited access making the ROV useful for inspecting the interior of holding tanks. A submersible, electrical power supply can be combined with the ROV to provide an intrinsically safe system which is particularly useful in environments where sparks pose a substantial hazard.

U.S. Pat. No. 5,039,254 A teaches a grabbing tool that is used with a submersible ROV. The ROV is controlled from a control ship by way of a tether and telemetry line. The ROV is designed to exhibit neutral buoyancy, and includes suitable propulsion devices for guiding it to a desired location, within the area of interest, as controlled from the ship. The submersible ROV includes manipulator arms that perform robotic tasks as controlled from the control ship. Suitable lights and one or more video cameras are also mounted on the ROV to provide an illuminated picture to the control ship of that which the ROV encounters as it moves about under water, or as the manipulator arms perform specific tasks. It may be necessary while performing some underwater tasks for the ROV to be more firmly anchored or stabilized.

U.S. Pat. No. 6,711,095 B1 teaches an untethered communications buoy system having an untethered buoy freely floating on the surface of water to not compromise the location of the submersible. The submersible has a cavity containing a first data interface member connected to a computer/data-storage that is connected to an acoustic transducer. The untethered buoy has a computer/memory module connected to a radio transceiver and acoustic transceiver. A second data interface member is connected to the computer/memory module and is mounted on the untethered buoy for fitting into the cavity and mating with the first data interface member. A ship is remotely located from the submersible and buoy and has a radio transceiver and an acoustic transceiver. Mating the first and second data interface members permits bidirectional downloading of data between the computer/data-storage and the computer/memory module.

U.S. Pat. No. 8,162,601 B2 teaches using an ROV to carry a bridge plug down to a subsea well. The ROV is operated from a surface vessel or platform and is outfitted with a submersible hydraulic pump and a manipulator arm. The ROV is provided with a carrying rack which can support a well closure assembly. The ROV includes an upper flotation pack. A metal support frame depends from the flotation pack and includes a tool sled. Sled extensions are fixed to the tool sled. The tool sled supports a submersible fluid pump that is preferably connected with the control cable to permit the pump to be actuated from the surface vessel. The ROV also includes propulsion thrusters and manipulator arms.

US 2010/0212573 A1 teaches a system for communicating with an underwater ROV includes an ROV coupled to a surface buoy by a tether. A controller is coupled to a first wireless transceiver and a second wireless transceiver is attached to the surface buoy. Control signals are transmitted from the controller through the first wireless transceiver to the second wireless transceiver on the surface buoy. The control signals are then transmitted through the tether to the ROV. Feedback and sensor signals are transmitted from the ROV through the wireless transceivers to the controller.

US 2010/0212574 A1 teaches a system for communicating with an underwater ROV that includes a winged ROV coupled to a surface buoy by a tether. A controller on a support ship is coupled to the tether and the control signals are then transmitted through the tether to the ROV. Feedback and sensor signals are transmitted from the ROV through the wireless transceivers to the controller. The wings of the ROV produce negative lift which is greater than the buoyant force of the ROV and the vertical tension forces on the tether.

SUMMARY OF THE INVENTION

There is provided in accordance with one aspect of the present invention a submersible ROV that is provided with four independently controllable swivel thruster assemblies that allow the submersible ROV to simulate the movement of a person equipped with scuba gear. The submersible ROV receives control signals from a controller located on the surface of the water or on land. The submersible ROV senses and transmits audio and visual images and transmits those signals to a base receiver located on the surface of the water or on land. Signals are transmitted to and from the submersible ROV via a tether. The tether may be connected either directly to the controller/base receiver or may be connected to an intermediate floating ROV with a power supply and wireless communication relay station. A person can vicariously experience scuba diving via the submersible ROV while remaining dry and safe on land or on a surface vehicle.

DETAILED DESCRIPTION OF THE INVENTION

Inasmuch as the present invention relates to the nautical field there are a few basic nautical terms used in the description and claims. As used herein and in the claims the term "ROV" is understood to mean a remotely operated vehicle or vessel. As used herein and in the claims the term "fore" when used as a noun is understood to mean the front part of a vessel, such as an ROV, and when used as an adverb means near or towards the front part of a vessel, such as an ROV. As used herein and in the claims the term "aft" when used as a noun is understood to mean the rear part of a vessel, such as an ROV, and when used as an adverb means near or towards the rear part of a vessel, such as an ROV. As used herein and in the claims the term "inboard" is understood to mean located nearer to or towards the midline of a vessel, such as an ROV. As used herein and in the claims the term "outboard" is understood to mean located away from the midline of a vessel, such as an ROV. As used herein and in the claims the term "starboard" is understood to mean the right side of a vessel, such as an ROV, as seen by someone who is aboard the vessel looking towards the front of the vessel, such as an ROV. As used herein and in the claims the term "port" is understood to mean the left side of a vessel, such as an ROV, as seen by someone who is aboard the vessel who is looking towards the front of the vessel, such as an ROV.

Figure 1:
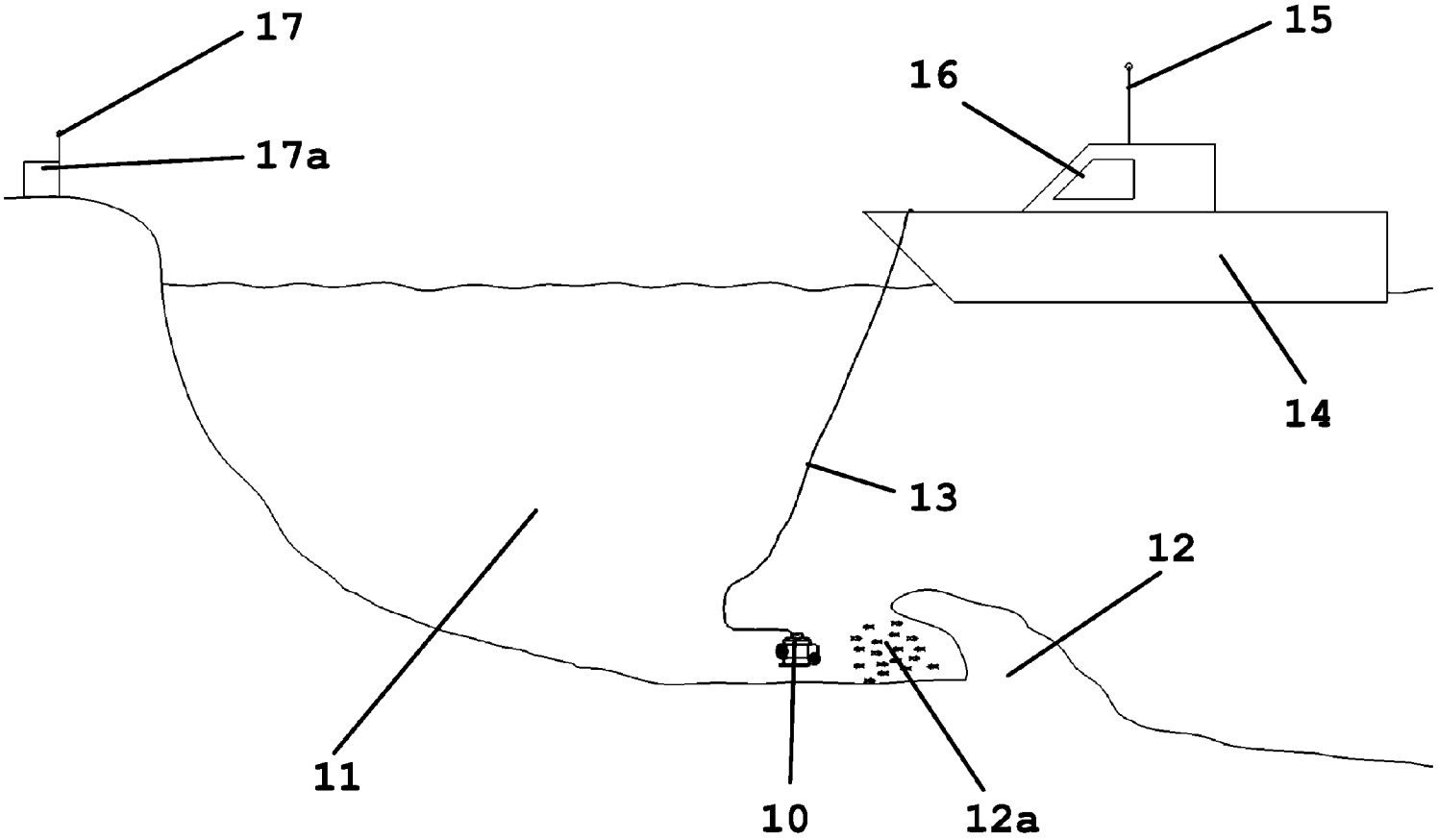
FIG. 1 is a schematic representation of a first exemplary embodiment of a system for using a submersible remotely operated vehicle (ROV) of the present invention.

Referring first to FIG. 1 there is shown a schematic representation of a first exemplary embodiment of a system for using a submersible ROV 10 to explore and observe underwater features such as a reef 12 and living creatures 12*a* in a body 11 of fresh or salt water. The submersible ROV 10 of the present invention may be provided with a hydrophone, video and/or still cameras, as well as instruments for sensing depth, water temperature, compass heading, and so forth. Details of the structure and function of the submersible ROV 10 are described in detail below with reference to FIGS. 4-18. In this first system the submersible ROV 10 is secured by a tether 13 to a base station 16 that is a combination power and communication relay station located on a surface vessel 14. It is understood that the base station may be installed permanently on the surface vessel or may be portable for transfer from one surface vessel to another or even to land. The tether 13 is provided with conductors for conducting power and control signals to the submersible ROV. Additional conductors associated with the tether conduct video and sound signals, and data such as water temperature, depth, and compass headings from the submersible ROV to the base station 16 that is located on the surface vessel 14. In this first embodiment the operator of the submersible ROV is located on the surface vessel 14. If desired, divers from the surface vessel may accompany the submersible ROV. It is understood that at least a visual recording of the images obtained using the submersible ROV may be made using appropriate equipment such as a laptop PC, tablet PC, DVD, Blu-ray or any other appropriate device.

The signals transmitted from the submersible ROV via the tether 13 may be retransmitted using an antenna 15 associated with the base station 16 that is a combination power and communication relay station on the surface vessel 14 to a second antenna 17 associated with a receiver 17*a* located on land. The signals that originate from the submersible ROV may be processed and displayed for observers on land at an appropriate facility such as a tourist resort, eating or drinking establishment, educational facility, research facility, military installation or the internet. This first exemplary system for using a submersible ROV of the present invention allows a person located on land to vicariously experience in real time making a trip as a scuba diver to observe underwater features such as a reef 12 and living creatures 12*a* while remaining comfortable, dry, and safe on land. This first exemplary system also allows any observers on board the surface vessel 14 to become the drivers of the ROV if so desired. It is understood that for all of the exemplary systems disclosed herein any number of underwater items may be observed, including but not limited to submerged vessels and other manmade items, coral reefs, and so forth. Advantages of the first exemplary embodiment include that the submersible ROV 10 can be deployed and retrieved and moved from one location to another efficiently by the crew of the surface vessel and that multiple surface vessels and submersible ROVs can transmit to a single land remote portable/fixed combination power and communication relay station on the land. This feature allows persons on the land to switch "programs" between images retrieved using submersible ROVs deployed at multiple locations and if desired switch which submersible ROV they are operating.

Figure 1A:
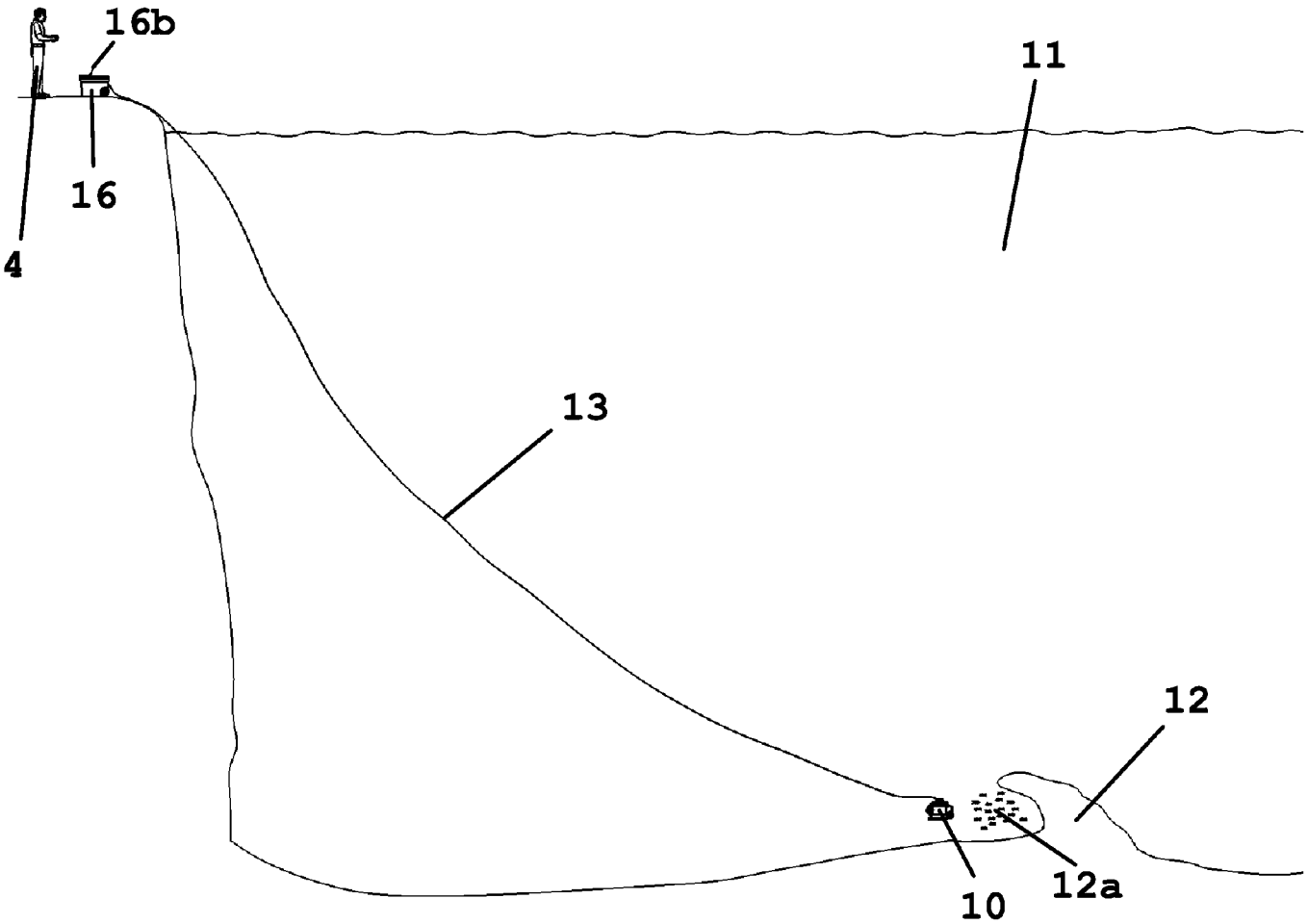
FIG. 1A is a schematic representation of a second exemplary embodiment of a system for using a submersible ROV of the present invention.

FIG. 1A is a schematic representation of an exemplary second embodiment of a system for using a submersible ROV 10 of the present invention. In this second system the submersible ROV 10 is submerged in a body of salt or fresh water 11 and is connected to a portable land based base station 16 that is a combination power and communication relay station by a tether 13 of the type described above with regards to FIG. 1. The portable land based base station 16 is substantially the same in structure and operation as the base station that is a combination power and communication relay station located on a surface vessel in the first embodiment described above with respect to FIG. 1. It is understood that a land based base station may be either a stationary device or a portable device. As shown in FIGS. 1B-1E the base station 16 is shown as being a portable device. A land based person 4 uses a controller (Joystick, Joypad, Keyboard, Flightstick) in conjunction with a Laptop PC 16*b* and appropriate software to send and receive control signals, data, video and sound information between the base station 16 and the submersible ROV 10. In the case of using a Tablet PC or Smartphone these devices run appropriate software and become the controller also. In this second exemplary system the land based person 4 has the experience of not only seeing and hearing signals originating at the submersible ROV 10 regarding underwater features such as a reef 12 and living creatures 12*a*, but also has the real time experience of causing the submersible ROV 10 to move about three axes simulating movements of the land based person 4 just as if he were making a scuba dive while seeing and hearing the sights and sounds sensed by the submersible ROV. However the land based person 4 remains dry, comfortable, and safe throughout his "diving experience". It is understood that as used herein and in the claims the term "land based person" is understood to refer to both a person standing on the ground or a ground covering member such as a concrete slab, but also to a person in a land based structure or on a structure extending from the ground over the water such as a pier. It is understood that at least a visual recording of the images obtained using the submersible ROV may be made using appropriate equipment such as a laptop PC, tablet PC, DVD, Blu-ray, or any other appropriate device. Advantages of this exemplary embodiment include the opportunity for a person to personally control a submersible ROV, and if multiple systems are available a plurality of persons can each have the experience of controlling a submersible ROV at the same time.

Figure 1B:
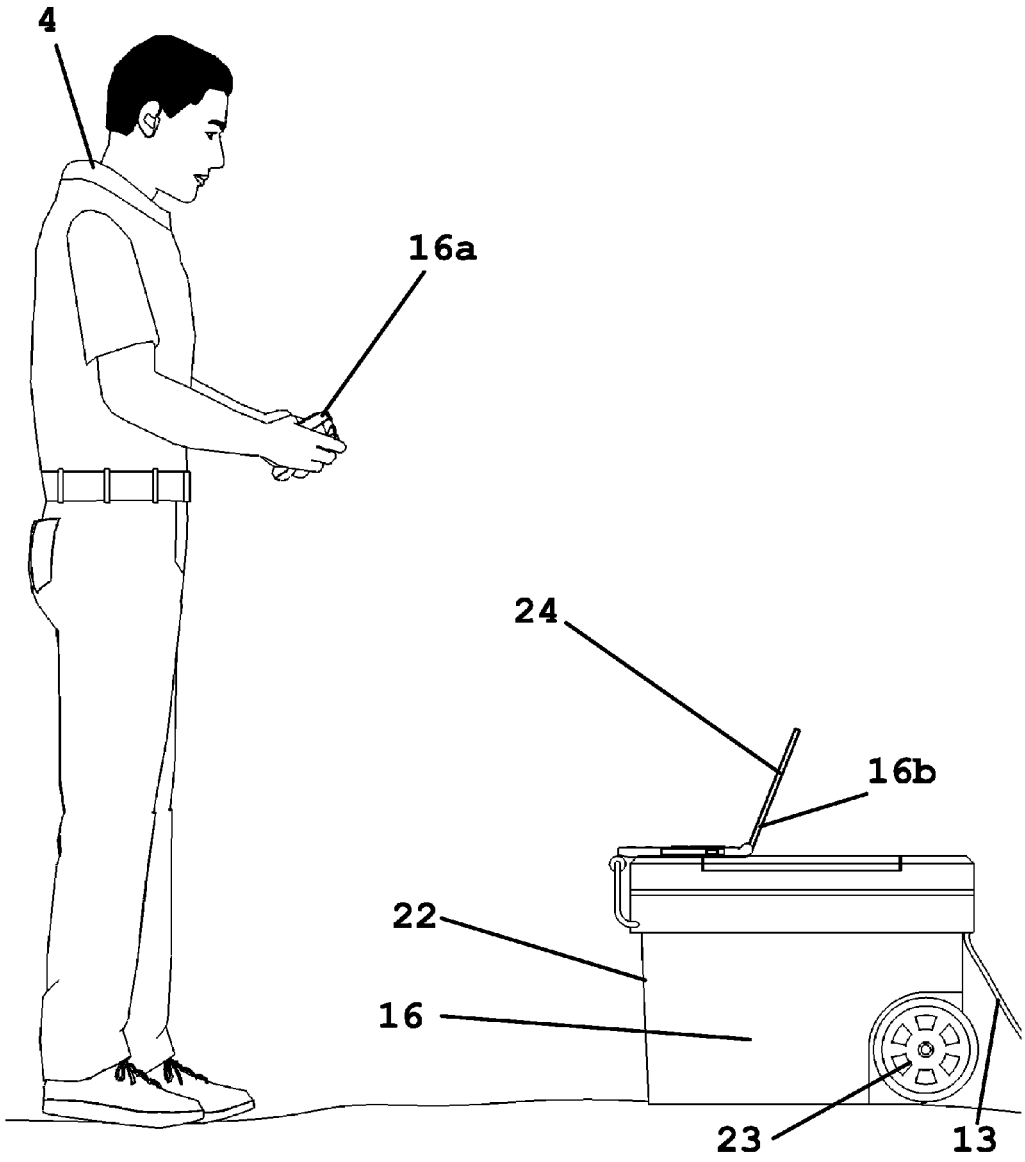
FIG. 1B is an enlarged view of a land based portion of the second exemplary system for using a submersible ROV that is shown in FIG. 1A.

FIG. 1B is an enlarged view of a land based portion of the second exemplary system for using a submersible ROV that is shown in FIG. 1A. The portable land based base station 16 that is a combination power and communication relay station may be housed at least in part in a container 22 provided with wheels 23 to facilitate moving the portable combination power and communication relay station as desired. The combination power and communication relay station is in circuit communication with a submersible ROV via a tether 13 as described above. In this exemplary embodiment a laptop computer 16*b* or other device with a video display screen 24 and speakers is in circuit communication with the base station 16. A person 4 uses a wireless device 16*a,* such as a joystick, joy pad, flight stick or other wireless controller to send command signals to laptop computer 16*b* which then relays those signals to the submersible ROV via the base station 16 and tether 13. The person can instruct various components of a submersible ROV of the present invention to change orientations to cause movement of the submersible ROV or control sensory devices such as a camera, microphone or LED light array that are components of the submersible ROV. The person can observe on a video display screen 24 of the laptop computer 16*b* in real time images obtained by a camera that is a component of the submersible ROV of the present invention. The person can hear via a speaker of the laptop computer in real time sounds obtained by a microphone that is a component of the submersible ROV of the present invention.

Figure 1C:
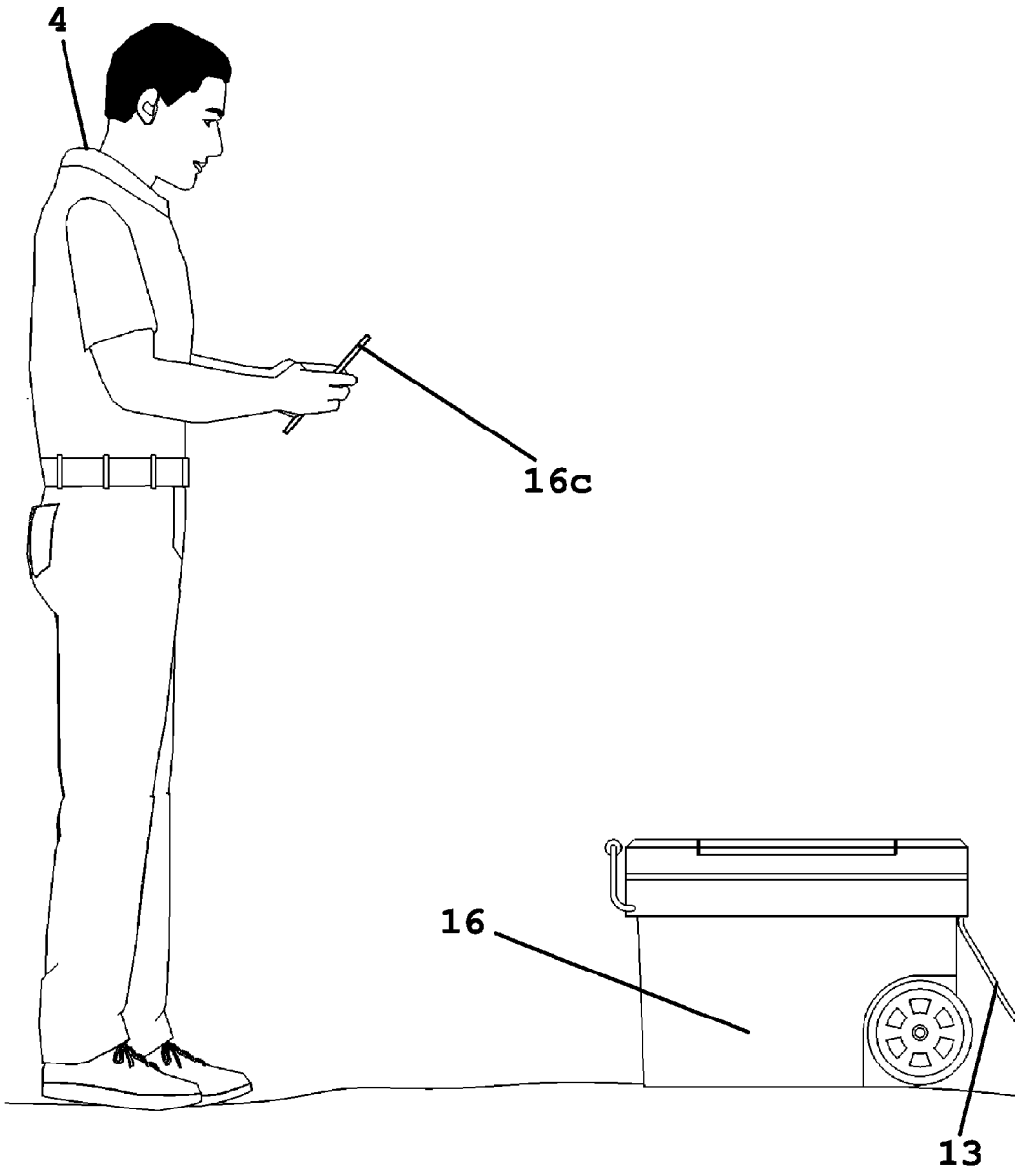
FIG. 1C is another enlarged view of a land based portion of the second exemplary system for using a submersible ROV that is shown in FIG. 1A.

FIG. 1C is an enlarged view of another aspect of the land based portion of the second exemplary system for using a submersible ROV that is shown in FIG. 1A. Here the person 4 uses a hand held electronic device such as a tablet computer or smartphone 16*c* that is in wireless communication with the base station 16. The tablet computer or smartphone 16*c* is provided with at least one appropriate program that allows the person to send command signals to the base station. The base station 16 is a combination power and communication relay station that transmits and receives signals to and from a submersible ROV via the tether 13 in a manner already described above. The person can instruct various components of a submersible ROV of the present invention to change orientations to cause movement of the ROV or control sensory devices such as a camera, microphone or LED light array that are components of the submersible ROV. The person can observe on a video display screen of the tablet computer or smartphone in real time video and images obtained by a camera that is a component of the submersible ROV of the present invention. The person can hear via a speaker of the tablet computer or smartphone in real time sounds obtained by a microphone that is a component of the submersible ROV of the present invention.

Figure 1D:
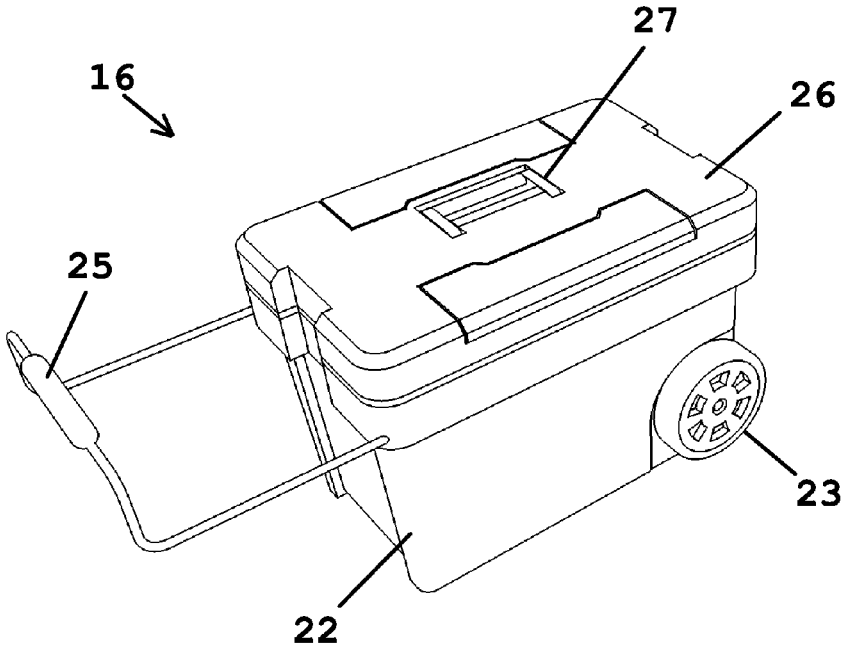
FIG. 1D is a perspective views of an exemplary portable base station that is a combination power and communication relay station of the second embodiment that is shown in FIG. 1A.
Figure 1E:
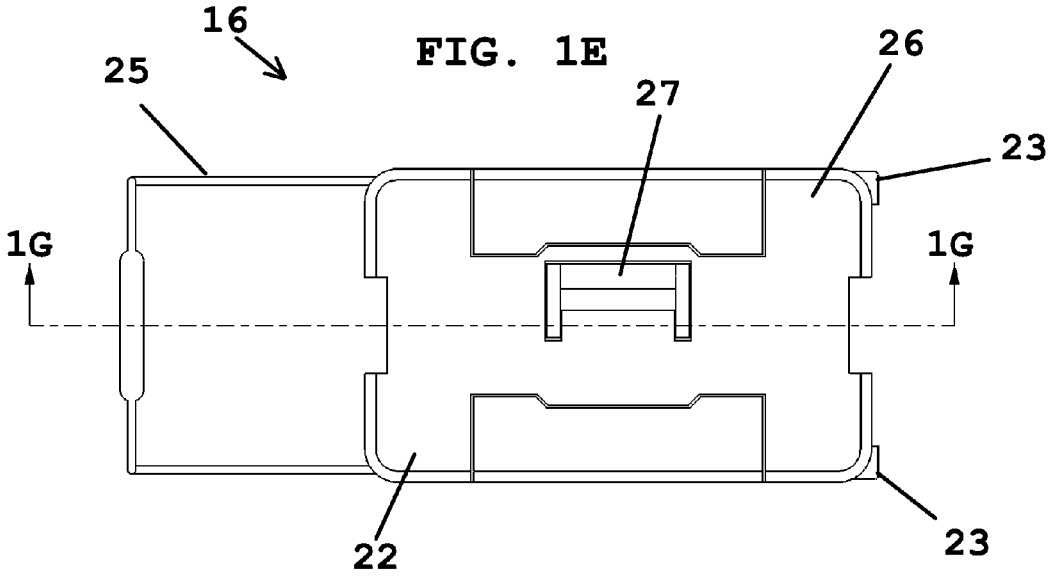
FIG. 1E is a top view of the exemplary portable base station.
Figure 1F:
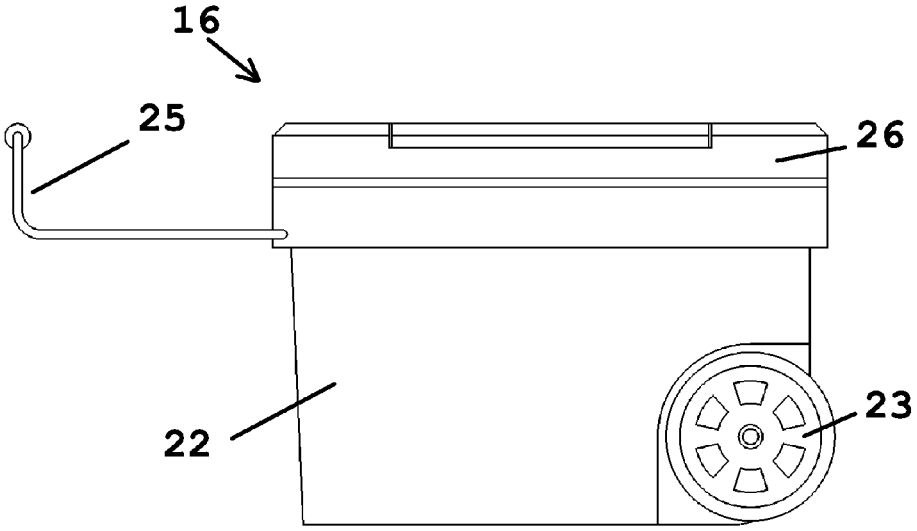
FIG. 1F is a side view of the exemplary portable base station.
Figure 1G:
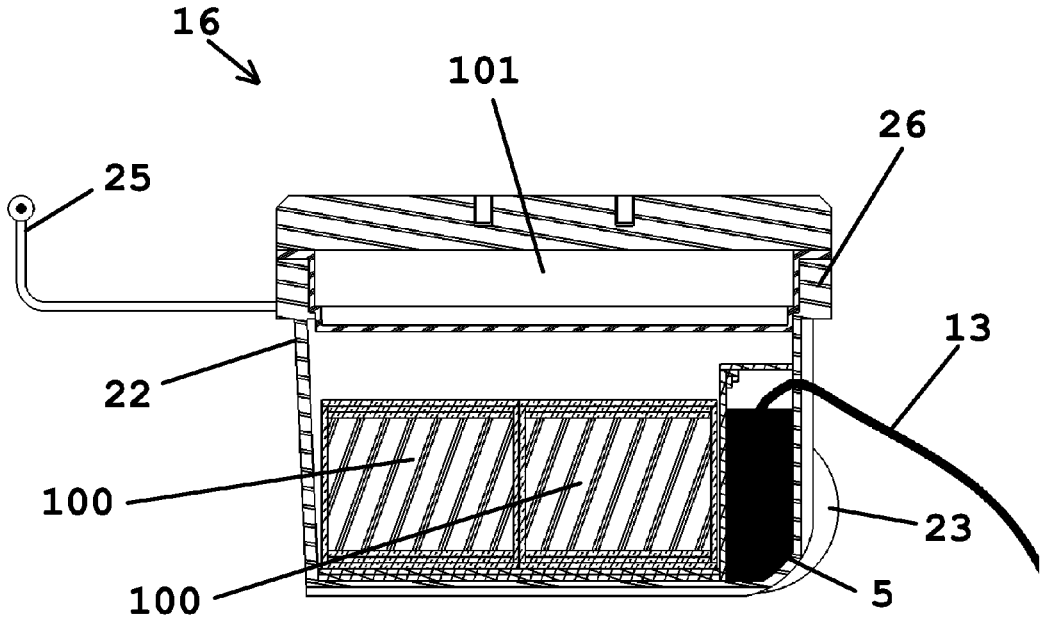
FIG. 1G is a section view, taken at line 1G-1G of FIG. 1E, of the exemplary portable base station.

The second exemplary embodiment of a system for using a submersible ROV of the present invention shown in FIGS. 1A-1C can be further understood by referring to FIGS. 1D-1G. FIG. 1D is a perspective view of an exemplary portable base station 16 that is a combination power pack and signal generator. FIG. 1E is a top view of the exemplary portable base station 16. FIG. 1F is a side view of the exemplary portable base station 16. FIG. 1G is a section view, taken at line 1G-1G of FIG. 1E, of the exemplary portable base station 16. The portable base station 16 includes a container 22 provided with wheels 23 and a handle 25 for pushing or pulling the base station to facilitate moving the base station as desired. The container 22 may be made of any suitable material such as a metal or plastic. It is understood that while the base station is shown as being portable in FIGS. 1B-1G, that the wheels 23 and handle 25 may be omitted if a person setting up a system to use a submersible ROV elects to have the base station installed permanently in a selected location. Whether portable or stationary a base station may be provided with at least one forty eight volt battery pack 100 and an electronics package 5. For example each power pack 100 may comprise four twelve volt batteries. The at least one battery pack may be replaced or supplemented by a forty eight volt DC converter pack for use in locations where one hundred ten volt AC power is available. The electronics package 5 communicates with a submersible ROV either directly via a tether 13 or indirectly via an intermediary relay station to be described in more detail below with regards to FIGS. 3B-3E. In the illustrated exemplary base station the tether 13 may be either permanently wired to the electronics package or may be attached in a removable manner using appropriate male and female connectors.

In an exemplary embodiment the submersible ROV operates on forty eight volt DC power which greatly diminishes electric shock hazards. When the submersible ROV is in direct circuit communication with the base station via a tether the at least one power pack 100 is used to provide all of the electrical requirements of the submersible ROV, including for example motors, sensors, microcomputer, LED array, compass or other components as required. The functions of the electronic package 5 may include, for example: a battery pack charger receptacle; a USB connection from a laptop or desktop PC to the tether: a wireless connection to a surface vessel or floating ROV; a wireless connection to a tablet PC or smart phone, battery pack hook up receptacles; a forty volt wiring harness; and any other suitable components.

A top cover 26 of the exemplary base station may be lifted or pivoted about a hinge using a handle 27 to provide access to a storage compartment for storing a laptop computer, spare parts and other articles relating to the use of the base station. It is understood that if the base station is connected to a power grid the current may be converted to an appropriate voltage and amperage to operate the system components that would otherwise be powered by the battery pack and that in such a configuration the power pack can be configured to provide backup power in the event of a loss of electric service from the power grid.

Figure 1H:
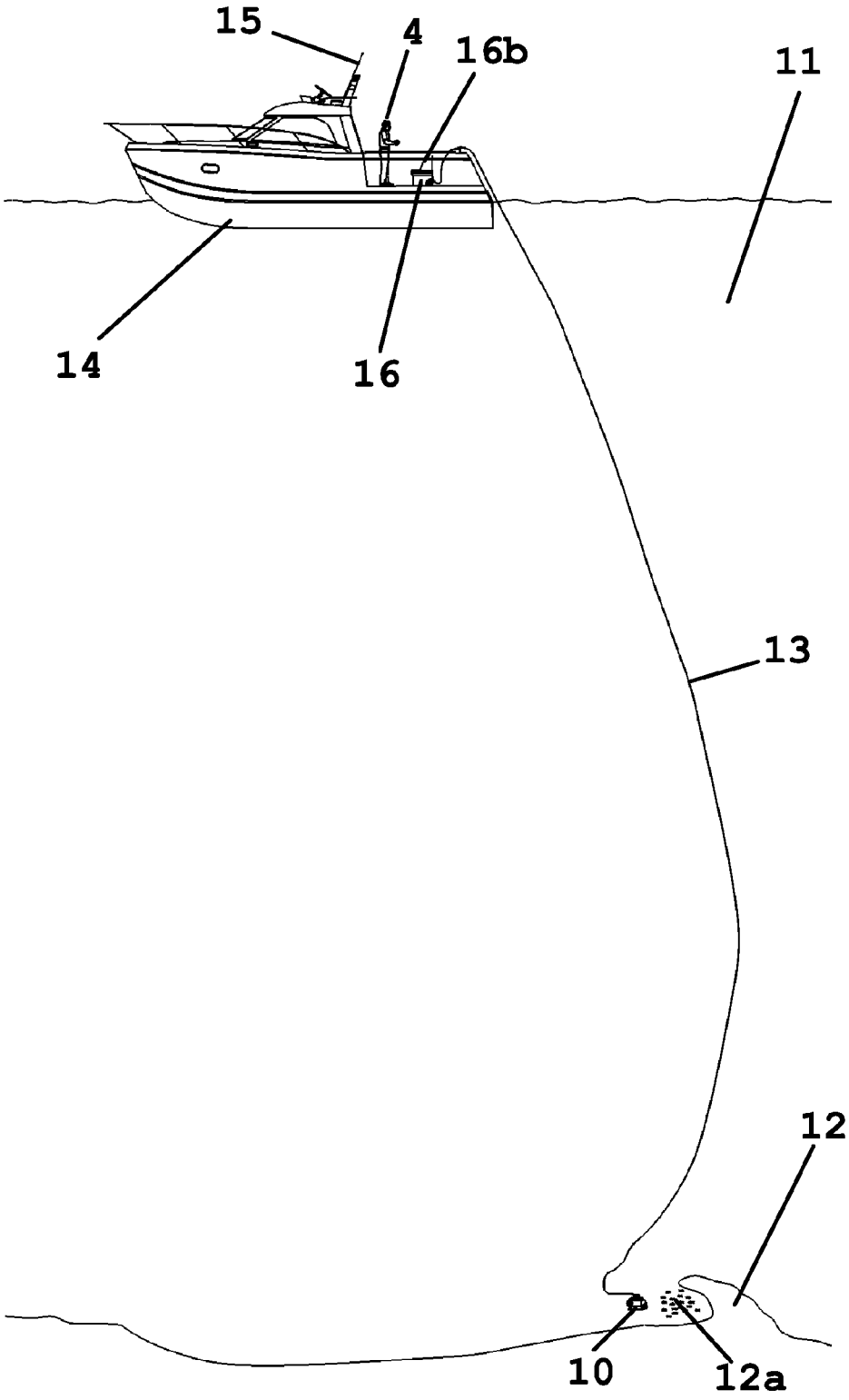
FIG. 1H is a schematic representation of a third exemplary embodiment of a system for using a submersible ROV of the present invention.

FIG. 1H is a schematic representation of a third exemplary embodiment of a system for using a submersible ROV 10 of the present invention. In this third exemplary embodiment the submersible ROV 10 is submerged in a body of fresh or salt water 11 and is connected to a base station 16 that is a combination power and communication relay station located on a surface vessel 14 by a tether 13 of the type described above with regards to FIG. 1. The base station 16 of this third exemplary embodiment is substantially the same as the base station described above with respect to FIGS. 1D-1G. A person 4 located on the surface vessel 14 is able to use controls and video and sound monitors 16*b* to send and receive signals between the base station 16 and the submersible ROV 10. Signals originating at the submersible ROV 10 may be further transmitted via an antenna 15 to a remote receiver located on land or another vessel. In this third exemplary system the vessel based person 4 has the experience of not only seeing and hearing signals originating at the submersible ROV 10 regarding underwater features such as a reef 12 and living creatures 12*a,* but also has the real time experience of causing the submersible ROV 10 to move about three axes simulating the movement of the vessel based person 4 as if he were making a scuba dive. However, the vessel based person 4 remains dry, comfortable and safe throughout his "diving experience". It is understood that at least a visual recording of the images obtained using the submersible ROV may be made using appropriate equipment such as a DVD recorder.

Figure 2:
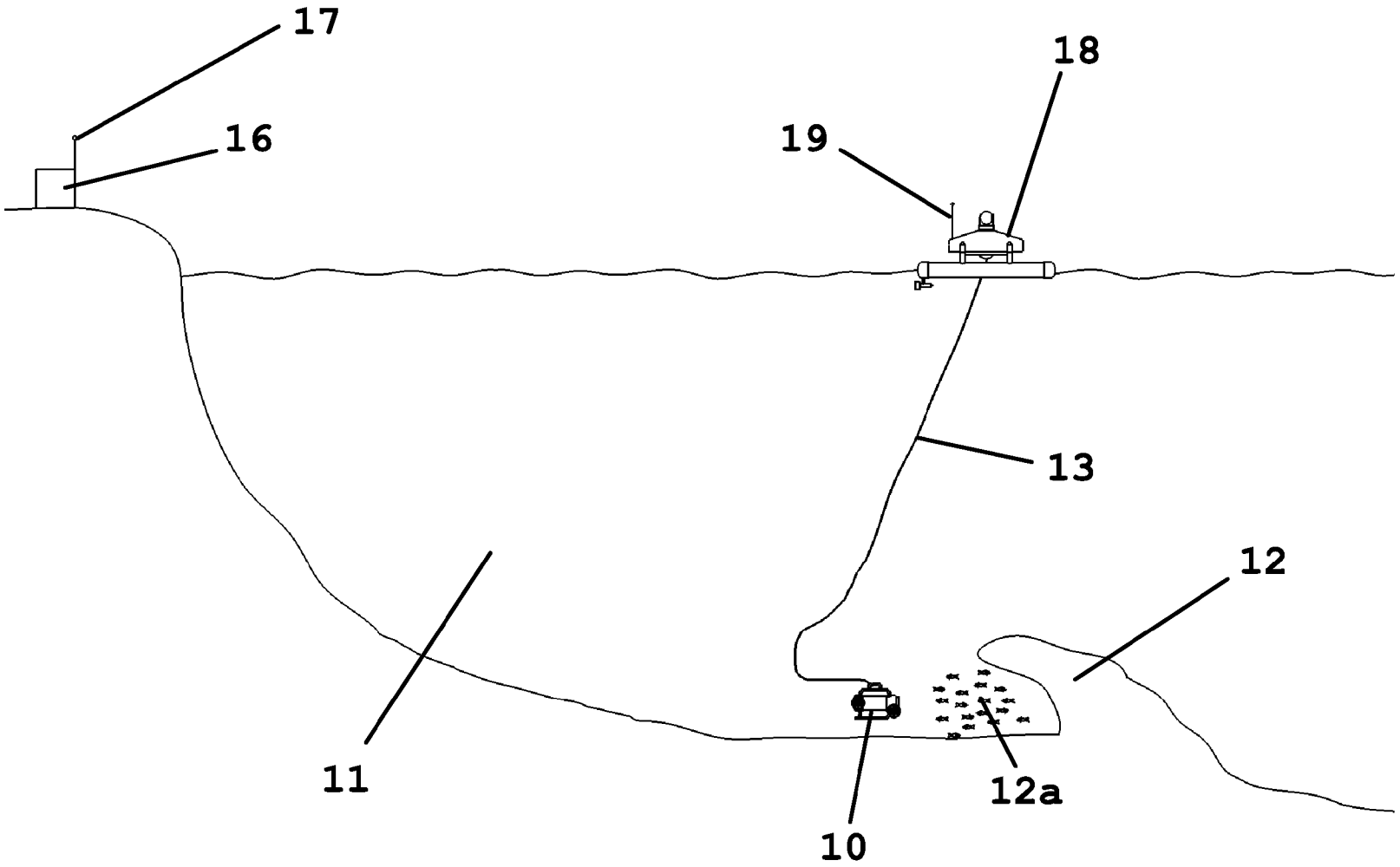
FIG. 2 is a schematic representation of a fourth exemplary embodiment of a system for using a submersible ROV of the present invention in conjunction with a floating ROV.

FIG. 2 is a schematic representation of a fourth exemplary system for using a submersible ROV 10 of the present invention. In this fourth system the submersible ROV 10 is submerged in a body of fresh or salt water 11 and is connected to a floating ROV 18 that is a power supply and signal relay station by a tether 13 of the type described above with respect to FIG. 1. The floating ROV power supply and signal relay station 18 is unmanned and preferably is self-propelled and can be remotely operated. That is to say the floating power supply and signal relay station 18 is preferably a floating ROV. However it is understood that in some uses of the fourth exemplary embodiment, such as a permanent installation at a resort or recreational facility, a floating power supply and signal relay station could be secured in a selected location by an anchor and a tether in the manner of a marker buoy to facilitate operators of the system having a substantially repeatable "scuba diving experience". In this fourth embodiment control signals are transmitted wirelessly to the floating power supply and signal relay station 18 from a land based base station 16 using an antenna 17. The base station has at least substantially the structure and functionality of the base station described above with respect to FIGS. 1D-1G. It is understood that in this fourth exemplary embodiment the base station could be located outdoors or indoors, for example inside a resort or recreational facility. An operator, not shown, can send control signals to operate various components of the submersible ROV to simulate the motions of the arms and legs of a scuba diver. The control signals are relayed to the submersible ROV 10 by the floating ROV 18 via the tether 13. Information such as depth, water temperature and compass heading, as well as audio and visual data collected by devices on the submersible ROV are transmitted from the submersible ROV 10 to the floating ROV 18 via the tether 13, and then relayed wirelessly to the land based base station 16 using antennas 19, 17. It is understood that at least a visual recording of the images obtained using the submersible ROV may be made using appropriate equipment such as a DVD recorder. Advantages of this fourth exemplary system and other systems using a floating power supply and signal relay station 18 are that the submersible ROV 10 may be effectively used further from shore than the system of FIG. 1 A without employing the cost of human labor employed operating a manual surface vessel.

Figure 2A:
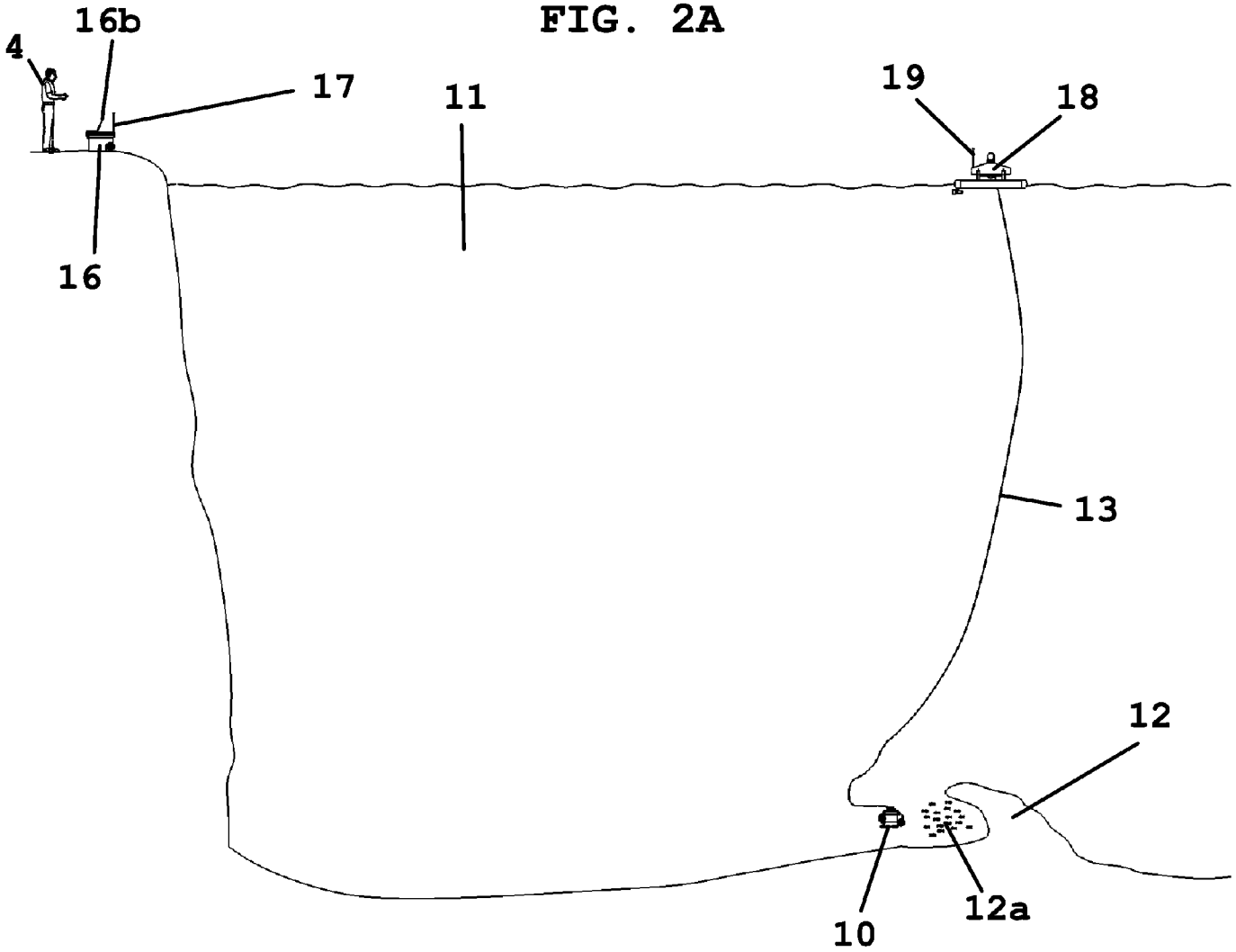
FIG. 2A is a schematic representation of a fifth exemplary embodiment of a system for using a submersible ROV of the present invention in conjunction with a floating ROV.

FIG. 2A is a schematic representation of a fifth exemplary embodiment of a system for using a submersible ROV of the present invention. Again in this fifth exemplary system the submersible ROV 10 is submerged in a body of fresh or salt water 11 that may contain underwater features such as a reef 12 and living creatures 12*a* and is connected to a floating ROV 18 that is a power supply and signal relay station by a tether 13 of the type described above with respect to FIG. 1. The floating ROV 18 is unmanned and preferably is self-propelled. The fifth exemplary embodiment is similar to the fourth exemplary embodiment but here the base station 16 is a portable land based base station 16 similar to the type shown described above with respect to FIGS. 1D-1G. The land based base station 16 is a combination power and communication relay station. In this exemplary embodiment a laptop computer 16*b* or other device with a video display screen and speakers is in circuit communication with the base station 16. A land based person 4 uses a wireless device 16*a*, such as a joystick, joy pad, flight stick or other wireless controller to send command signals to the base station 16 as described above with respect to FIG. 1B. Alternatively the person 4 may use a hand held electronic device such as a tablet computer or smartphone 16*c* that is in wireless communication with the base station 16 as described above with respect to FIG. 1C. The person 4 can instruct various components of a submersible ROV of the present invention to change orientations to cause movement of the submersible ROV or control sensory devices such as a camera or microphone. The base station wirelessly transmits the control signals initiated by the person 4 using an antenna 17 to an antenna 19 of a floating ROV 18. The control signals are relayed to the submersible ROV 10 by the floating ROV 18 that is a power supply and signal relay station via the tether 13. Information such as depth, water temperature and compass heading, as well as audio and visual data collected by devices on the submersible ROV are transmitted from the submersible ROV 10 to the floating ROV 18 via the tether 13, and then relayed wirelessly to the land based base station 16 using antennas 19 and 17. The person 4 can observe on a video display screen of the laptop computer 16*b*, or on the video display screen of a tablet computer or smartphone, in real time images obtained by a camera that is a part of the submersible ROV. The person can hear via a speaker of the laptop computer in real time sounds obtained by a microphone that is a part of the submersible ROV. It is understood that at least a visual recording of the images obtained using the submersible ROV may be made using appropriate equipment such as a DVD recorder. The advantage of the portable land based base station is that the base station may be moved from location to location along with the floating ROV 18, tether, and the submersible ROV 10. This provides flexibility in the use of the portable base station including leasing or renting the system to various clients. The land based person 4 has the real time experience of causing the submersible ROV 10 to move about three axes simulating the movement of the land based person 4 as if he were making a scuba dive, and seeing and hearing the sights and sounds sensed at the submersible ROV 10. However, the land based person 4 remains dry, comfortable, and safe throughout his "diving experience". It is to be understood that one or more land based base stations 16 and associated floating and submersible ROVs 10, 18 may be used concurrently in a single commercial or scientific operation, and that such an operation may be facilitated by placing the land based base stations on a mobile platform such as a motor vehicle or a trailer towed by a motor vehicle.

Figure 2B:
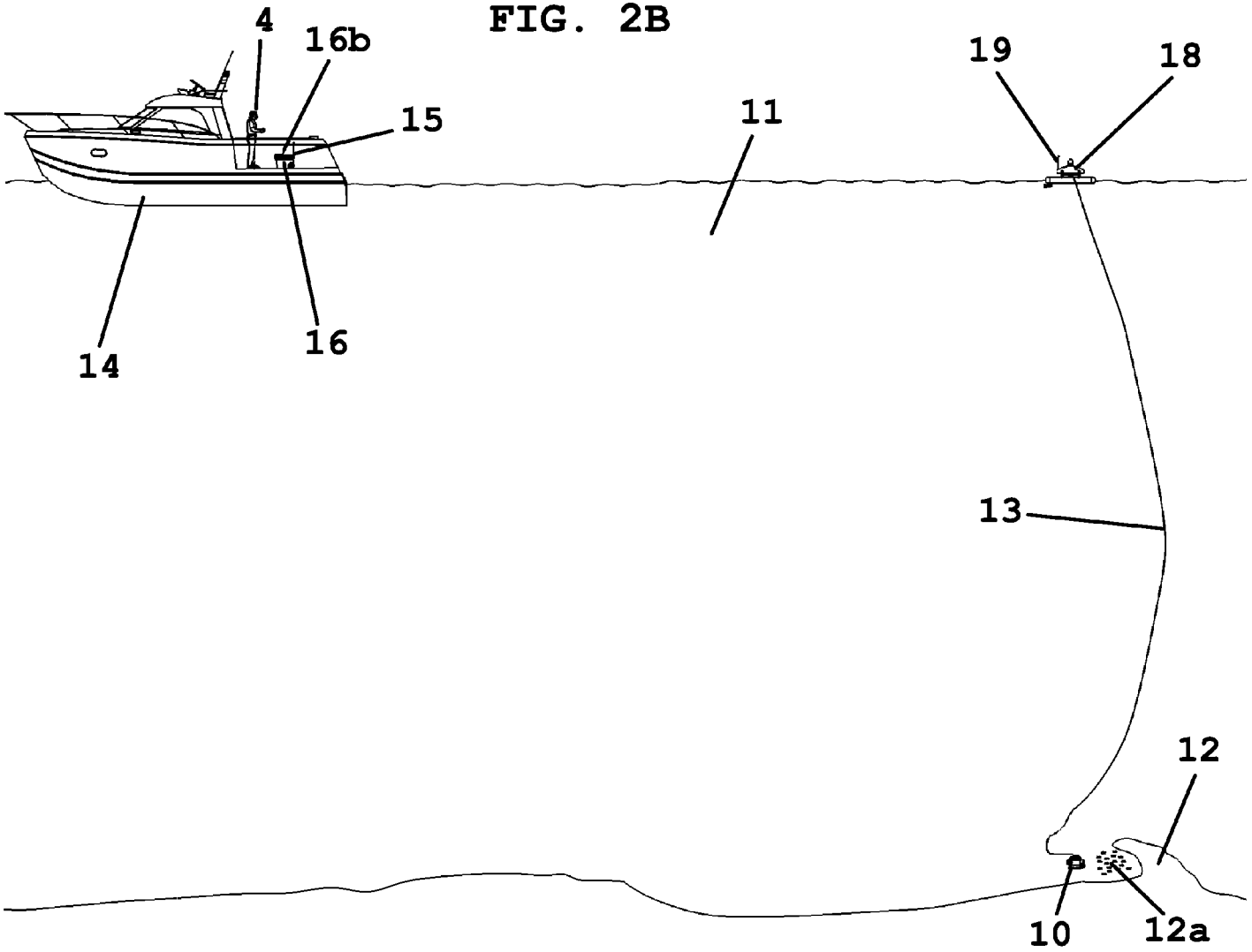
FIG. 2B is a schematic representation of a sixth exemplary embodiment of a system for using a submersible ROV of the present invention in conjunction with a floating ROV.

FIG. 2B is a schematic representation of a sixth exemplary system for using a submersible ROV 10 of the present invention. The sixth exemplary system is similar to the fifth exemplary system shown in FIG. 2A, however instead of a person 4 being land based he is located on a surface vessel 14. In this sixth exemplary embodiment the submersible ROV 10 is submerged in a body of fresh or salt water 11 and is connected to a floating ROV 18 that is a power supply and signal relay station of the type described with respect to FIG. 2A by a tether 13 of the type described above with respect to FIG. 1. Signals controlling the submersible ROV 10 and the operation of the floating ROV 18 originate at a vessel based base station 16 operated by a person 4 on the vessel 14. The vessel based person 4 uses controls and monitors 16*b* to control and monitor signals received and transmitted by an associated vessel based antenna 15 to an antenna 19 of the floating ROV 18, then through the tether 13 to the submersible ROV 10. Signals generated at the submersible ROV 10, including video images of underwater features such as a reef 12 and living creatures 12*a*, are transmitted via the tether 13 to the floating ROV 18, then via an associated antenna 19 to the vessel based antenna 15 and the vessel based controller 16. The vessel based person 4 has the real time experience of causing the submersible ROV 10 to move about three axes simulating the movement of the vessel based person 4 just as if he were making a scuba drive, and seeing and hearing the sights and sounds sensed at the submersible ROV 10. However, the vessel based person 4 remains dry, comfortable, and safe throughout his "diving experience".

Figure 3:
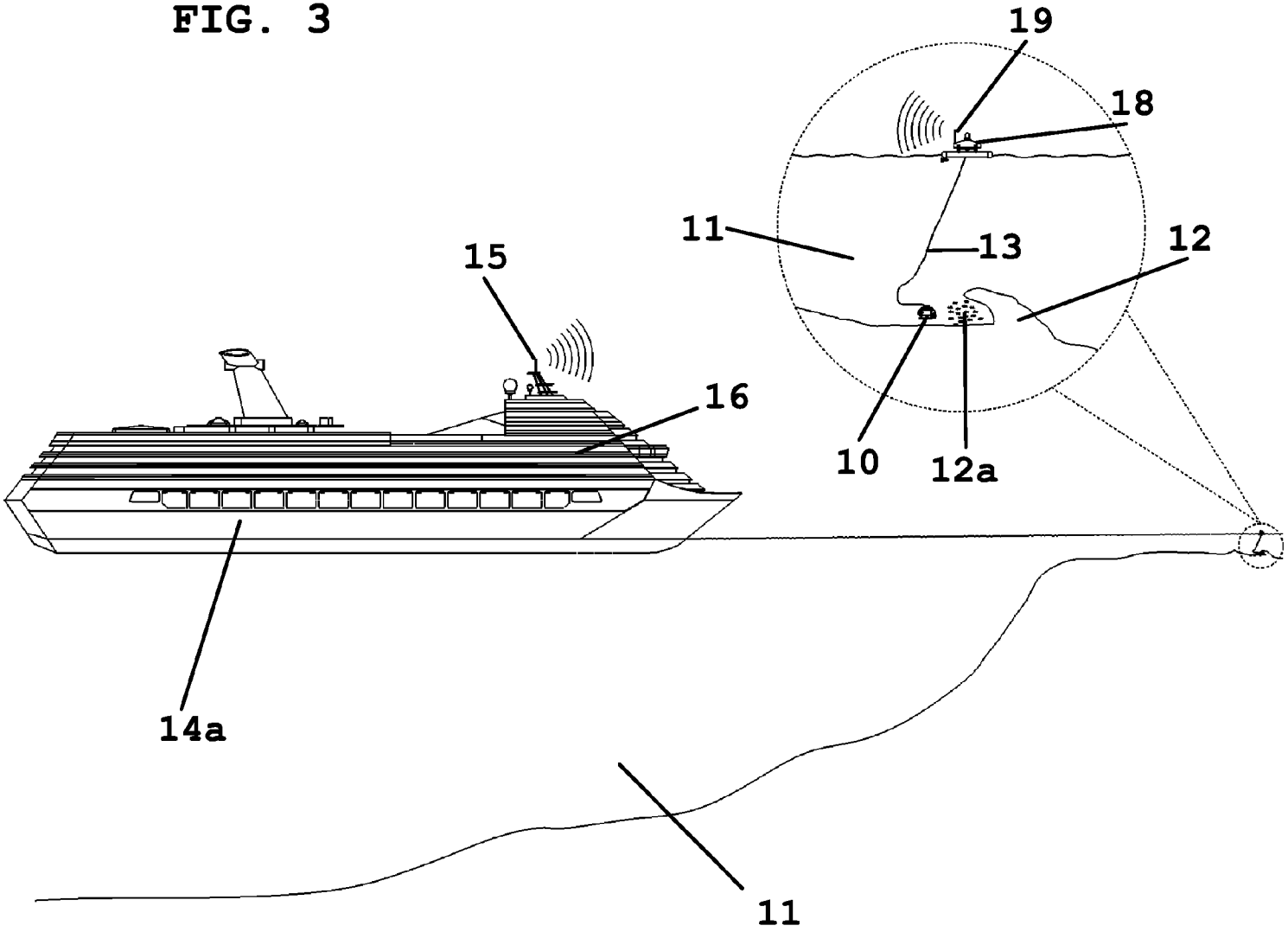
FIG. 3 is a schematic representation of a seventh exemplary embodiment of a system for using a submersible ROV of the present invention in conjunction with a floating ROV.

FIG. 3 is a schematic representation of a seventh exemplary system for using a submersible ROV of the present invention. Again in this seventh exemplary system the submersible ROV 10 is submerged in a body of fresh or salt water 11 that may contain underwater features such as a reef 12 and living creatures 12*a* and is connected to a floating ROV 18 that is a power supply and signal relay station by a tether 13 of the type described above with respect to FIG. 1. This seventh exemplary system is similar to the sixth exemplary system shown in FIG. 2B except the surface vessel is a large cruise ship 14*a*. At least one base station 16 located on the cruise ship may or may not be accessible to use by one or more cruise ship passengers. The operator of the cruise ship 14*a*, which operates on a large body of water 11, may either have a commercial arrangement with the owner/operator of a submersible ROV 10 or the cruise ship operator may own the submersible ROV 10. The submersible ROV 10 is submerged in a location selected for the presence of marine life 12*a*, an interesting geologic formation 12, or some other interesting underwater object such as a sunken ship. Each submersible ROV 10 is connected by a tether 13 to a floating ROV 18 as described above. At least one antenna 15 on the cruise ship 14*a* sends and receives signals for each ship board base station 16. Images and sounds sensed by each submersible ROV 10 can then be broadcast over a closed circuit system to public and private spaces on the cruise ship for the entertainment of cruise ship passengers.

Figure 3A:
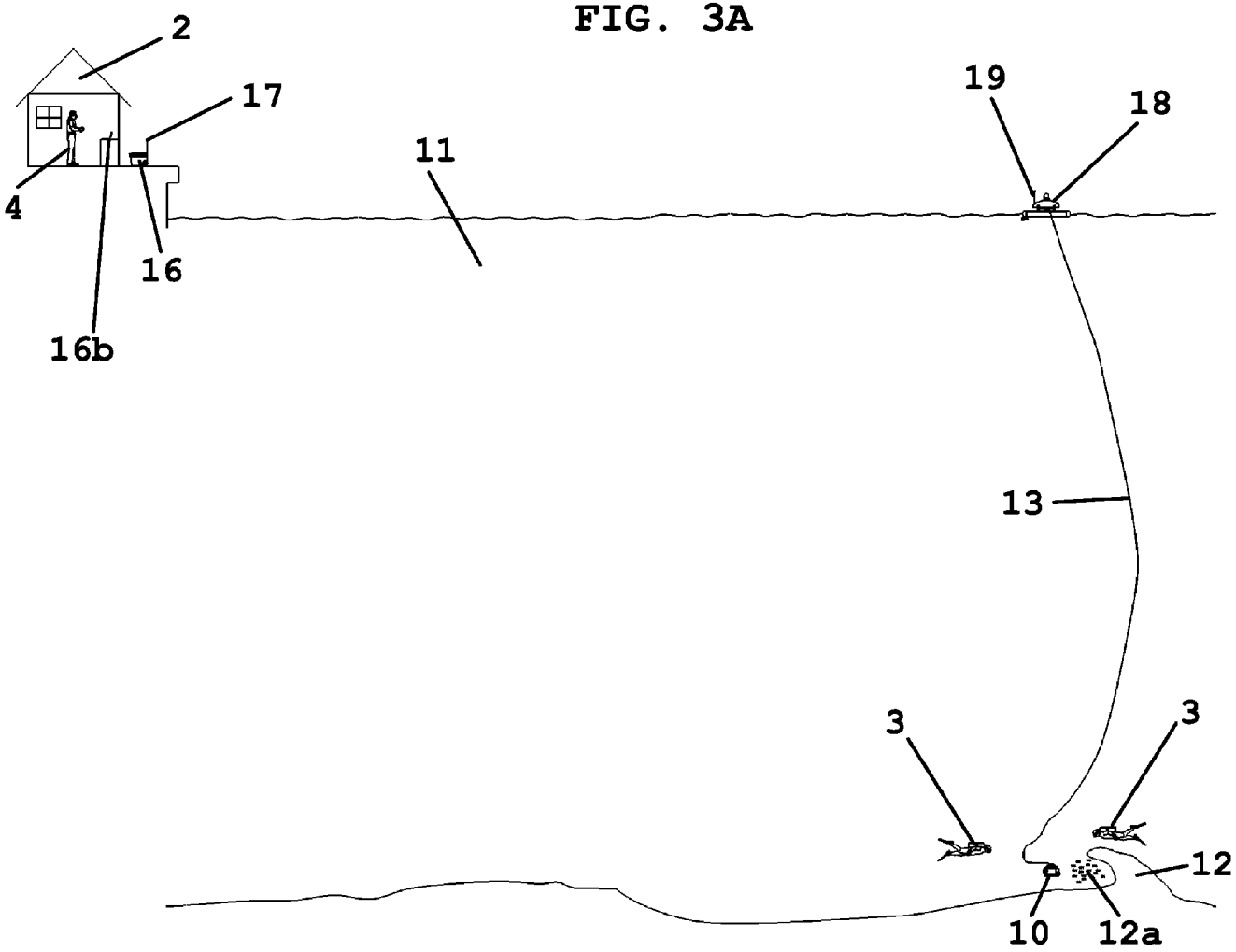
FIG. 3A is a schematic representation of an eighth exemplary embodiment of a system for using a submersible ROV of the present invention in conjunction with a floating ROV.

FIG. 3A is a schematic representation of an eighth exemplary system for using a submersible ROV of the present invention. Again in this eighth exemplary system the submersible ROV 10 is submerged in a body of fresh or salt water 11 that may contain underwater features such as a reef 12 and living creatures 12*a* and is connected to a floating ROV 18 that is a power supply and signal relay station by a tether 13 of the type described above with respect to FIG. 1. This eighth exemplary system is similar to the fifth exemplary system shown in FIG. 2A. However, while the base station 16 in the fifth exemplary system is a portable controller, this eighth exemplary system has the base station 16, controls, and laptop computer 16*b*, and associated land based antenna 17 stationary and associated with a land based structure 2. The structure 2 is located at least nearby a body of salt or fresh water 11. A person 4 may be a customer who pays a fee to be allowed to control and monitor signals from the submerged ROV 10. As in the previously described exemplary systems the submersible ROV is in two way communication with the land based controller 16*a* via the tether 13 and the floating ROV 18 with an associated antenna 19. Scuba divers 3 operating in the vicinity of marine life 12*a*, geologic formations 12 and other items of interest can have their real dive experience memorialized by visual and audio recordings made of the images and sounds sensed by the ROV 10. The sounds and images sensed by the submersible ROV 10 can include images of the divers 3.

Figure 3B:
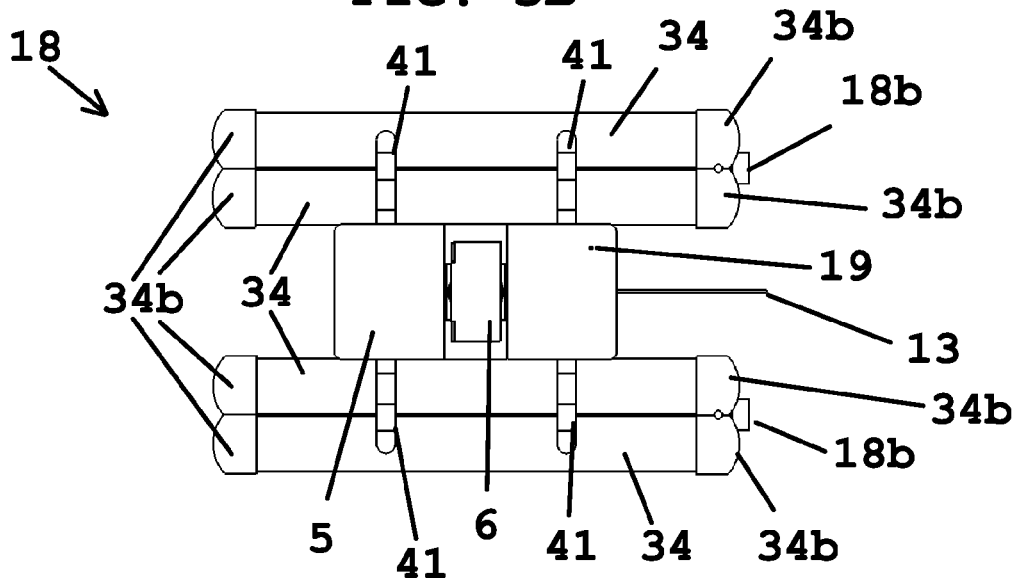
FIG. 3B is a top view of an exemplary floating ROV power supply and wireless communication relay station for use with the systems shown in FIGS. 2-3A.
Figure 3C:
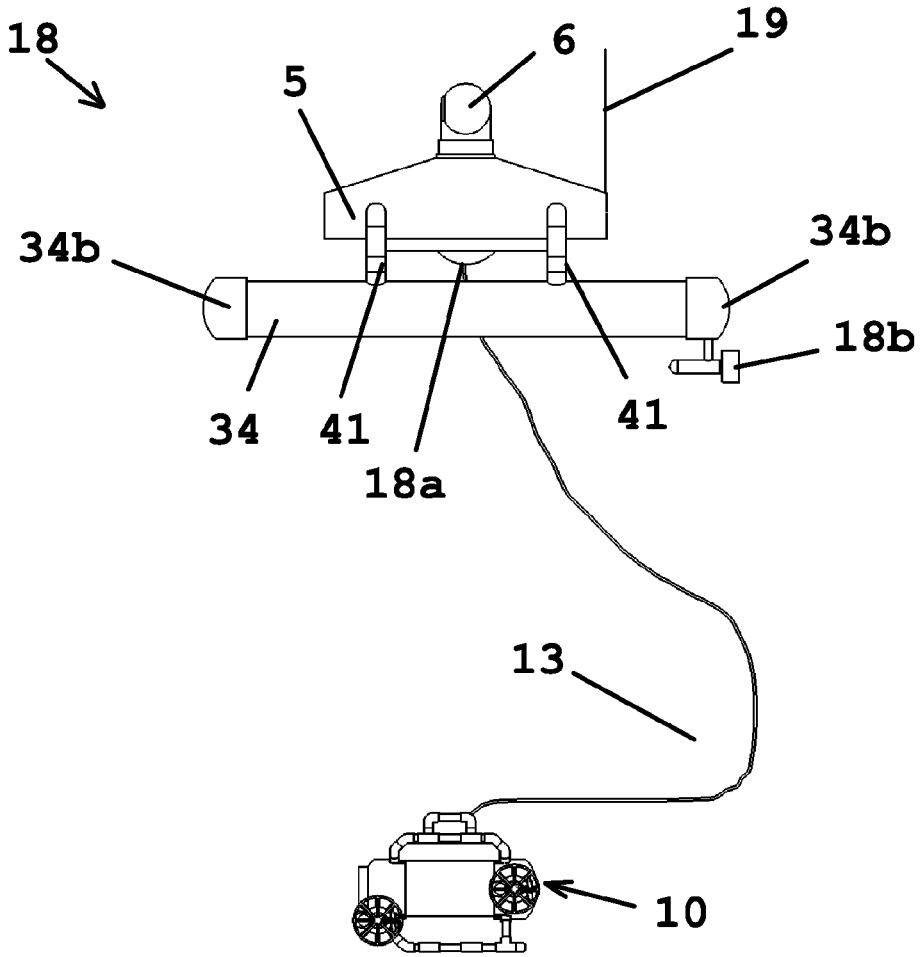
FIG. 3C is a side view of the exemplary floating ROV power supply and wireless communication relay station assembled with a deployed submersible ROV.
Figures 3D, 3E:
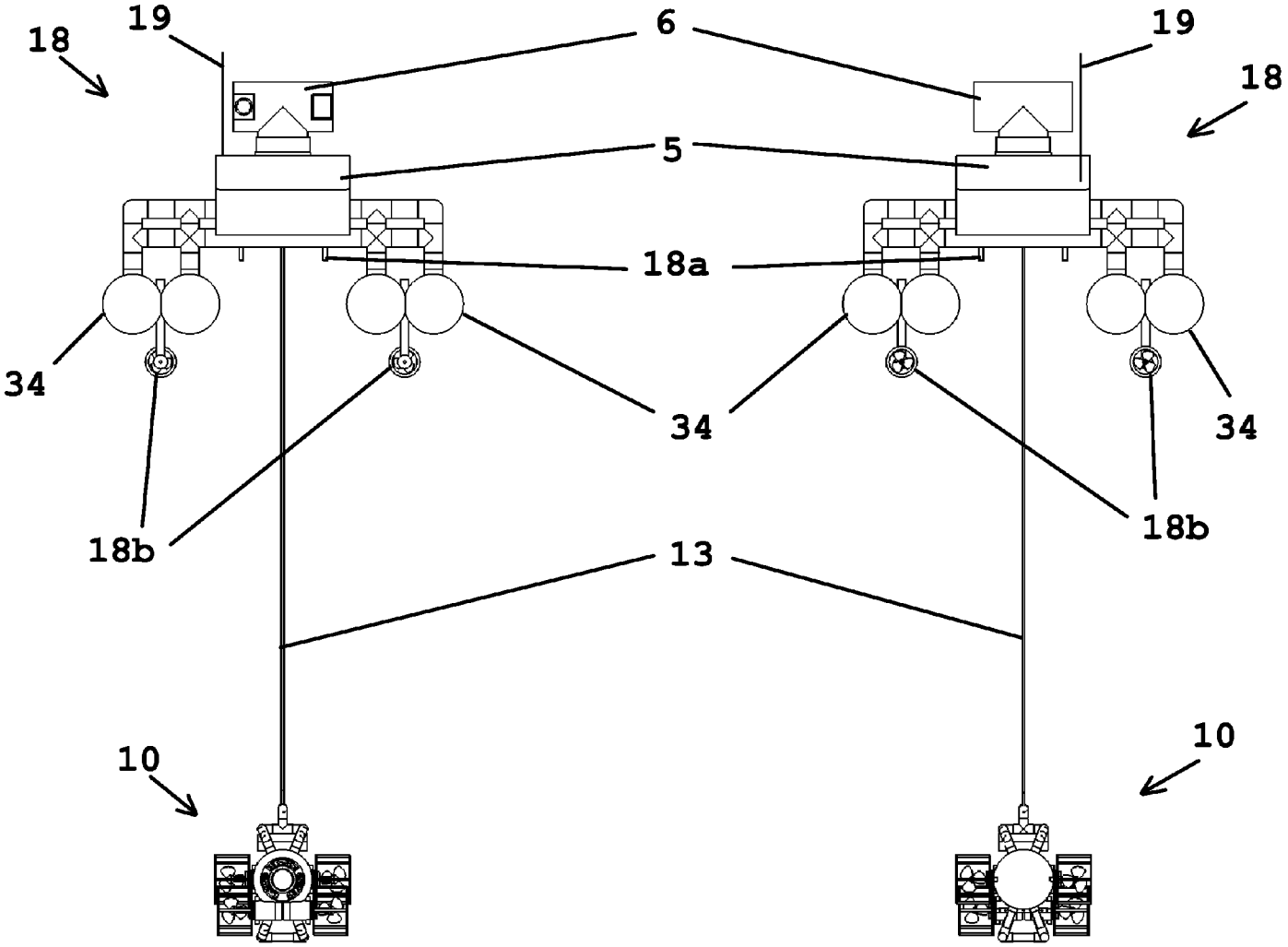
FIG. 3D is a view looking towards the front (fore) end of the exemplary floating ROV power supply and wireless communication relay station assembled with a deployed submersible ROV.
FIG. 3E is a view looking towards the back (aft) end of the exemplary floating ROV power supply and wireless communication relay station assembled with a deployed submersible ROV.
Figure 3F:
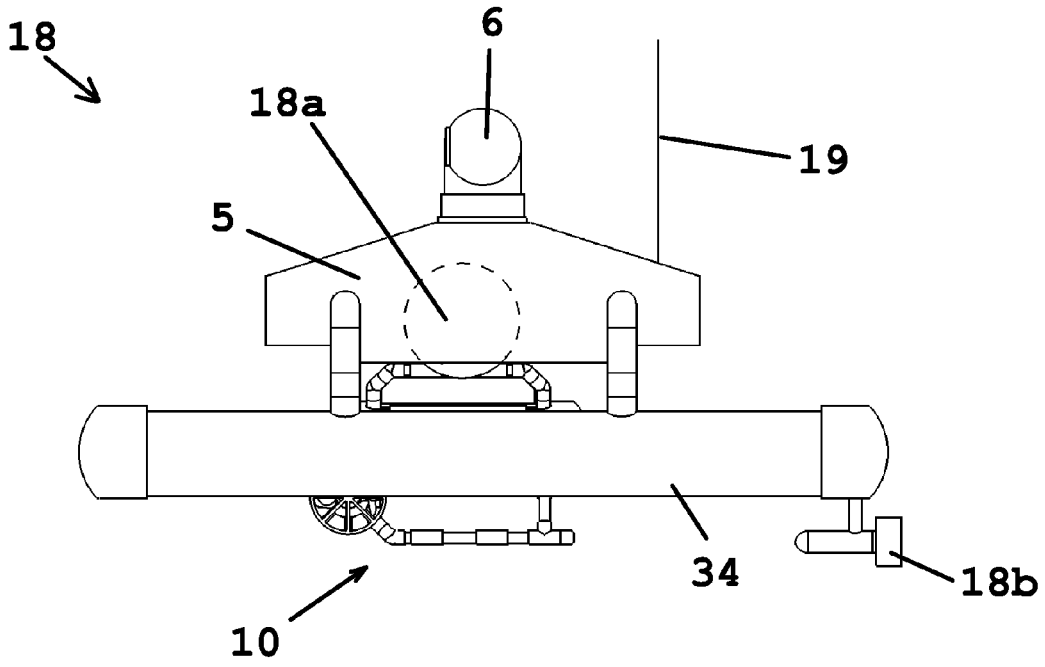
FIG. 3F is a side view of an exemplary floating ROV power supply and wireless communication relay station assembled with a submersible ROV that is docked to the floating ROV.
Figure 3G:
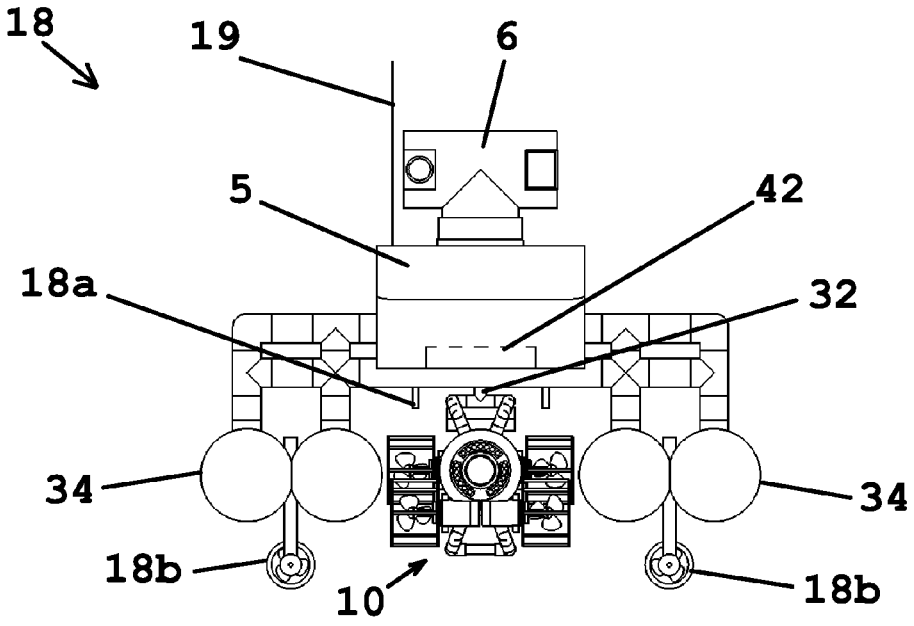
FIG. 3G is a front (fore) view of the exemplary floating ROV power supply and wireless communication relay station assembled with a submersible ROV that is docked to the floating ROV.
Figure 3H:
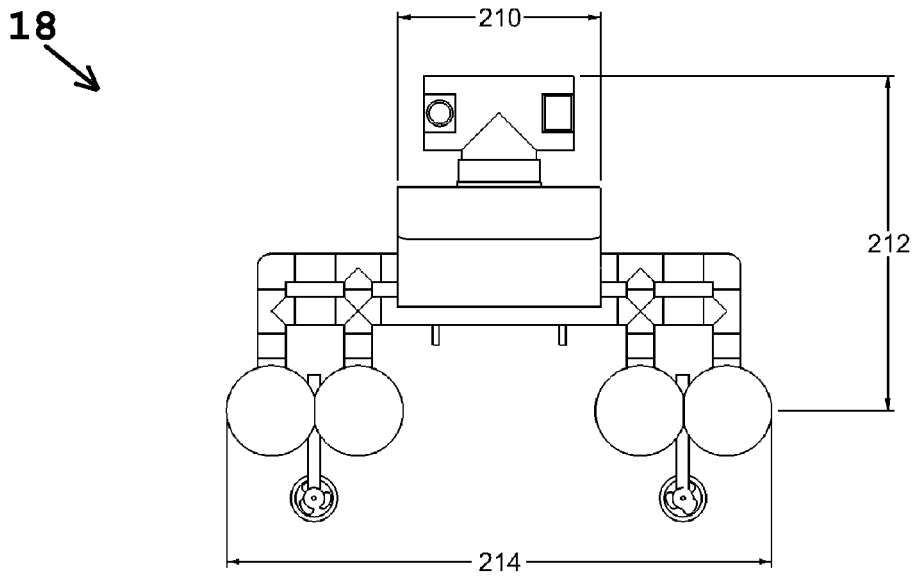
FIG. 3H is a front (fore) view of the exemplary floating ROV power supply and wireless communication relay station with exemplary dimensions indicated thereon.
Figure 3I:
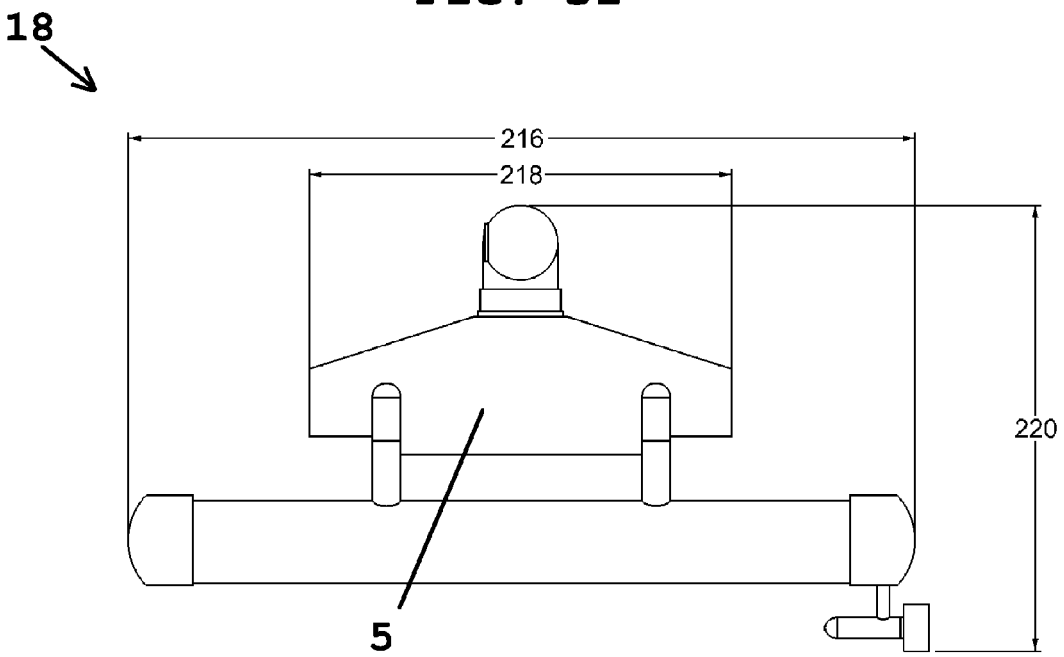
FIG. 3I is a side view of the exemplary floating ROV power supply and wireless communication relay station with exemplary dimensions indicated thereon.

FIGS. 3B-3I are schematic representation of an exemplary floating ROV 18 that is a power supply and signal relay station for use with a submersible ROV in the exemplary systems shown in FIGS. 2-3A. FIG. 3B is a top view of the exemplary floating ROV 18. FIG. 3C is a side view of the exemplary floating ROV 18 assembled with a deployed submersible ROV 10. FIG. 3D is a view looking towards the front (fore) end of the exemplary floating ROV 18 assembled with a deployed submersible ROV 10. FIG. 3E is a view looking towards the back (aft) end of the exemplary floating ROV 18 assembled with a deployed submersible ROV 10. FIG. 3F is a side view of the exemplary floating ROV 18 assembled with a submersible ROV 10 that is docked to the floating ROV 18. FIG. 3G is a front (fore) view of the exemplary floating ROV 18 assembled with a submersible ROV 10 that is docked to the floating ROV 18. FIG. 3H is a front (fore) view of the exemplary floating ROV 18 with exemplary dimensions indicated thereon. FIG. 3I is a side view of the exemplary floating ROV 18 with exemplary dimensions indicated thereon.

The floating ROV 18 has a pair of spaced apart parallel extending floats 29. As shown each of the float comprises a pair of side by side hollow tubular components that are closed at both ends. In a prototype the hollow tubular components were lengths of six inch diameter PVC pipe sealed at each end with PVC caps 34*b*. It is understood that alternatively each of the floats could comprise only a single length of appropriately sized PVC piping sealed at each end with PVC caps. In the exemplary floating ROV 18 the floats are secured in position by hollow support members 41 that are fixed to both the floats 34 and a waterproof housing 5 for electronic components. The support members may have any suitable configuration selected in accordance with good engineering practice. In a prototype the support members were fabricated from lengths of one and a half inch diameter PVC piping fixed to one another with appropriate PVC fittings. An antenna 19 for sending signals to and receiving signals from a land or vessel based base station as described above is fixed to the waterproof housing 5 for electronic components. In a prototype floating ROV a combination LED light array and pan tilt zoom camera with infrared capability 6 was mounted to the top of the waterproof housing 5 for electronic components. In a prototype floating ROV 18 there was located inside the waterproof housing 5 for electronic components including at least a communications package and controllers for controlling the operation of both the floating ROV and an associated submersible ROV 10. The waterproof housing 5 for electronic components further contains a powered take up and release reel assembly 18*a* for a tether 13 that extends between the floating and submersible ROVs. In a prototype floating ROV 18 the hollow floats 34 contain storage batteries for powering the operation of both the floating and submersible ROVs. The storage batteries are in circuit communication via the hollow support members 41 with both the electronic and electrical components on board the floating ROV and further via the tether 13 with both the electronic and electrical components on board the submersible ROV. In a prototype floating ROV 18 the floating ROV is propelled from place to place and maneuvered using a pair of thrusters 18*b* having propellers powered by appropriate electric motors. In a prototype floating ROV 18 the thrusters did not pivot but could operate at differing speeds to facilitate maneuvering of the floating ROV 18. It is understood that any appropriate propulsion system can be used with the floating ROV.

Exemplary dimensions of a prototype floating ROV 18 can best be presented with reference to FIGS. 3H and 3I wherein FIG. 3H is a front (fore) view of the exemplary floating ROV 18 and FIG. 3I is a side view of the exemplary floating ROV 18. A prototype floating ROV 18 has a width (beam) 214 of about three feet and seven and three quarters inches. A prototype floating ROV 18 has an overall length 216 of about five feet and three inches. A prototype floating ROV 18 has an overall height 220 of about two feet and eleven and three quarter inches. The waterproof housing 5 for electronic components of a prototype floating ROV 18 has a length 218 of about two feet and ten inches and a width 210 of about one foot four and a quarter inches. A prototype floating ROV 18 has extends, exclusive of the antenna, above the water a distance 212 of about two feet and six and one half inches.

As stated previously a submersible ROV 10 is tethered to a floating ROV 18 by a tether 13 that has one end fixed in both circuit and load bearing communication to both the submersible and floating ROVs. When the floating ROV 18 is being deployed the submersible ROV 10 is preferably docked to the floating ROV as shown in FIGS. 3F and 3G. The powered take up and release reel assembly 18*a* located primarily inside the waterproof housing 5 for electronic components has almost all of the tether 13 retracted thereon when the submersible ROV 10 is docked to an underside of the floating ROV 18. A prototype floating ROV 18 has a slot (not shown) in the lower side of the waterproof housing 5 for electronic components for receiving a carry handle 32*a* of the submersible ROV that functions as a docking hook and is secured to a latching mechanism 42 located inside the waterproof housing 5 for electronic components.

When the floating ROV 18 is at a location on the surface above a feature such as a geologic formation, marine life or a sunken vessel that a person desires to see, the carry handle 32*a* of the submersible ROV is released by the latching mechanism 42 located inside the waterproof housing 5 for electronic components and the tether 13 is released by the powered take up and release reel assembly 18*a* located primarily inside the waterproof housing 5 for electronic components allowing the submersible ROV 10 to descend to a selected depth an move about in a deployment as depicted for example in FIGS. 3D and 3E.

Figure 4:
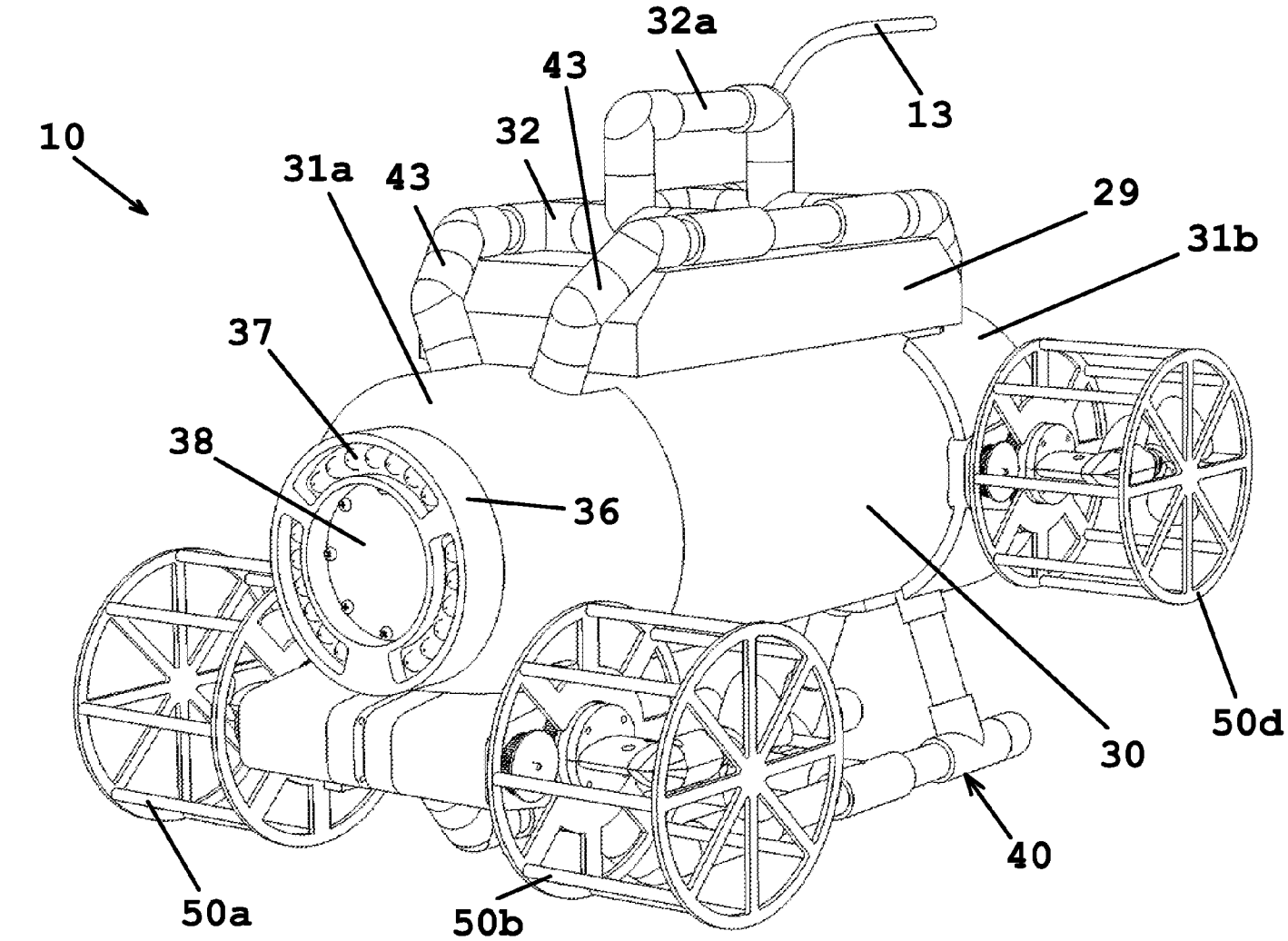
FIG. 4 is perspective view of an exemplary submersible ROV of the present invention.
Figure 5:
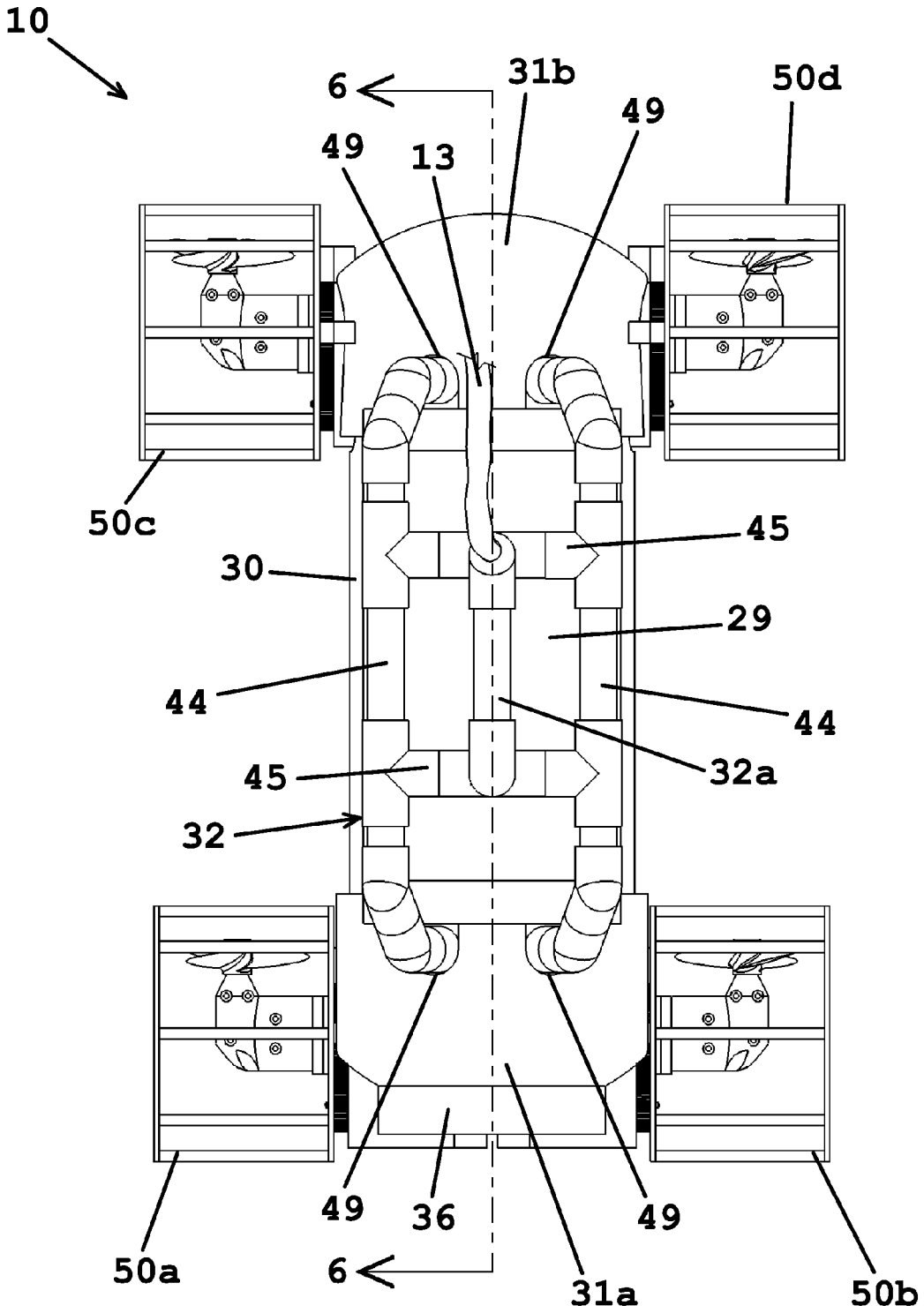
FIG. 5 is a top view looking down on the exemplary submersible ROV of FIG. 4.
Figure 6:
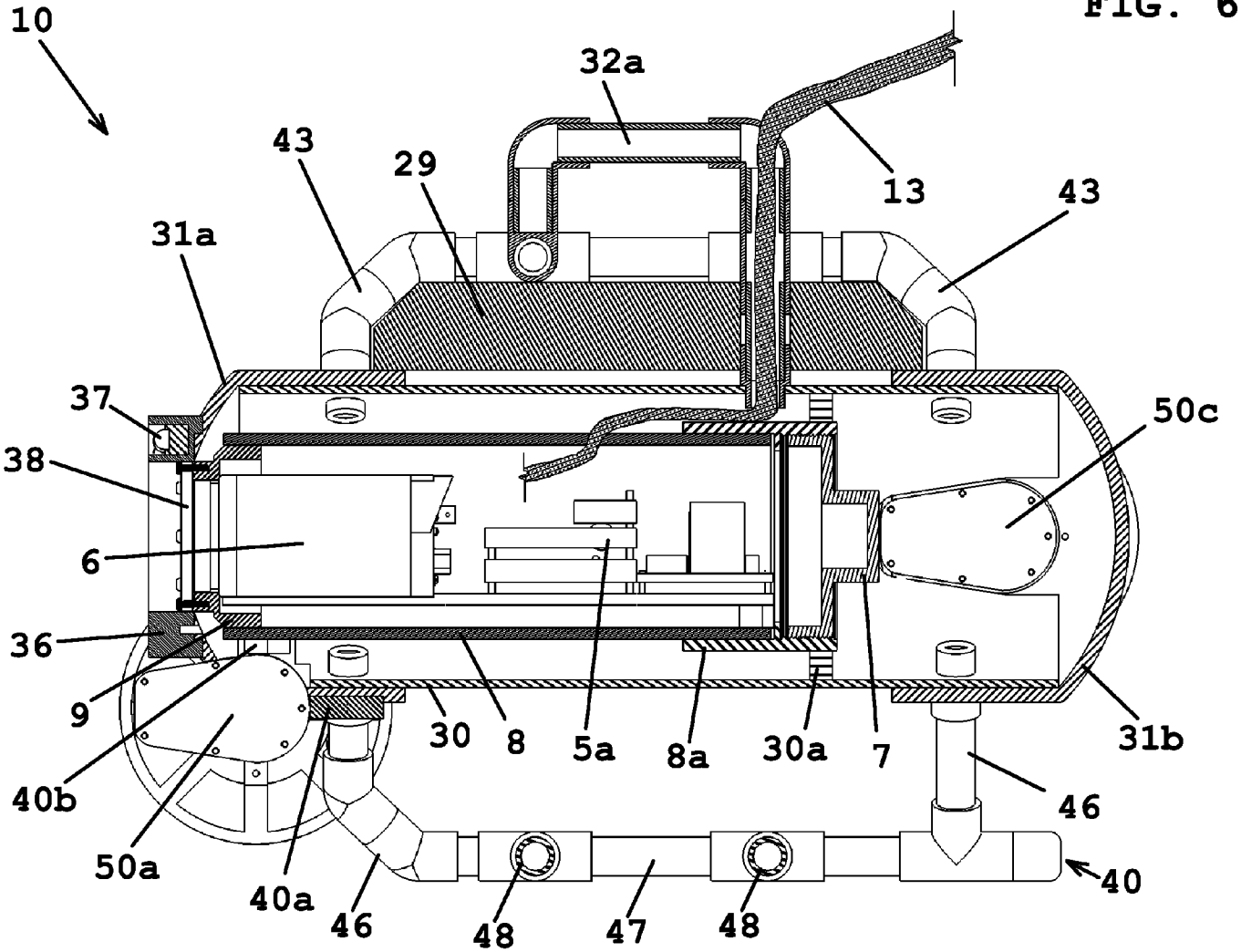
FIG. 6 is a longitudinal cross section of the exemplary submersible ROV taken at section line 6-6 of FIG. 5.
Figure 6A:
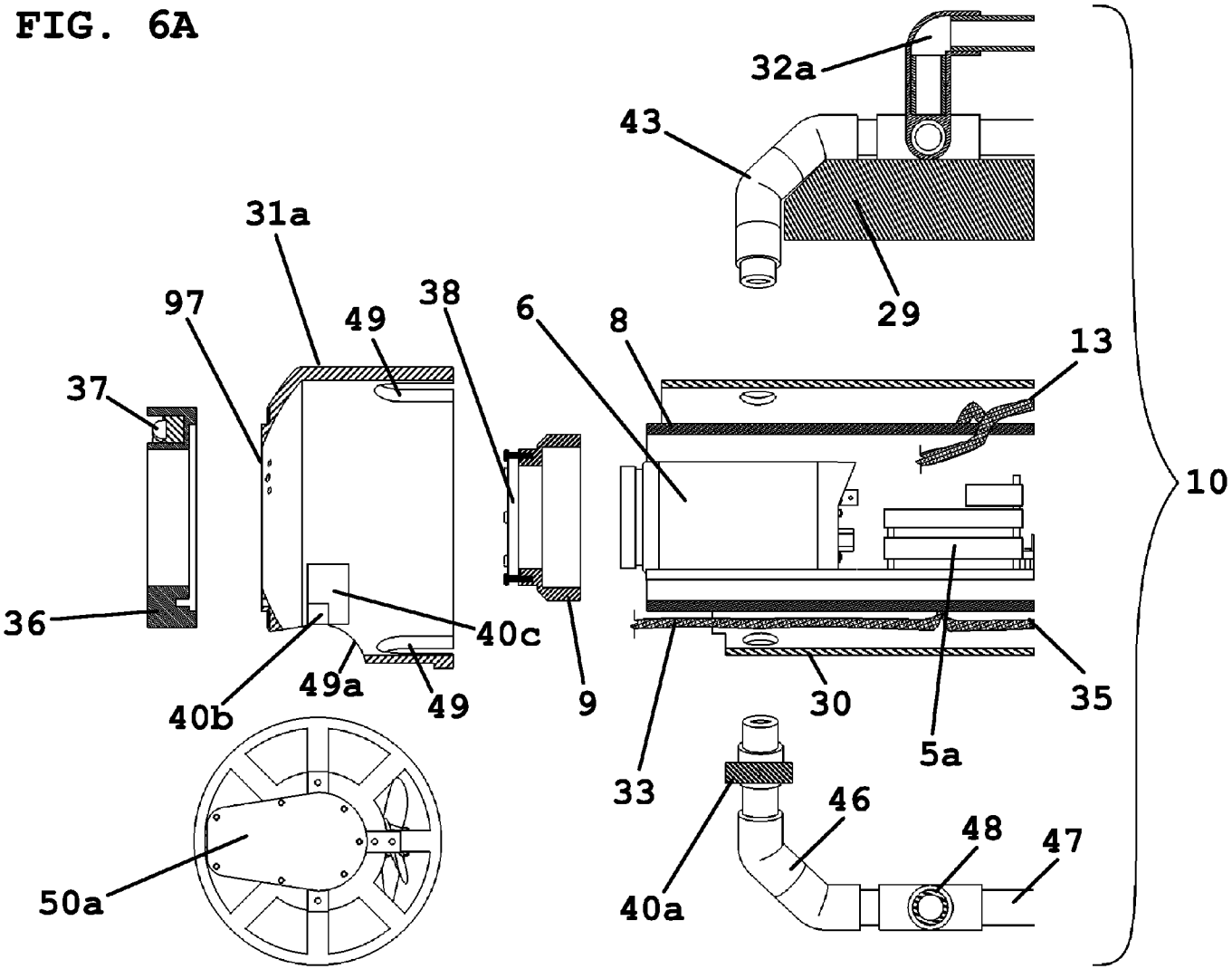
FIG. 6A is a fragmentary exploded longitudinal cross section view of the forward (fore) portion of the exemplary submersible ROV shown in FIG. 6.
Figure 6B:
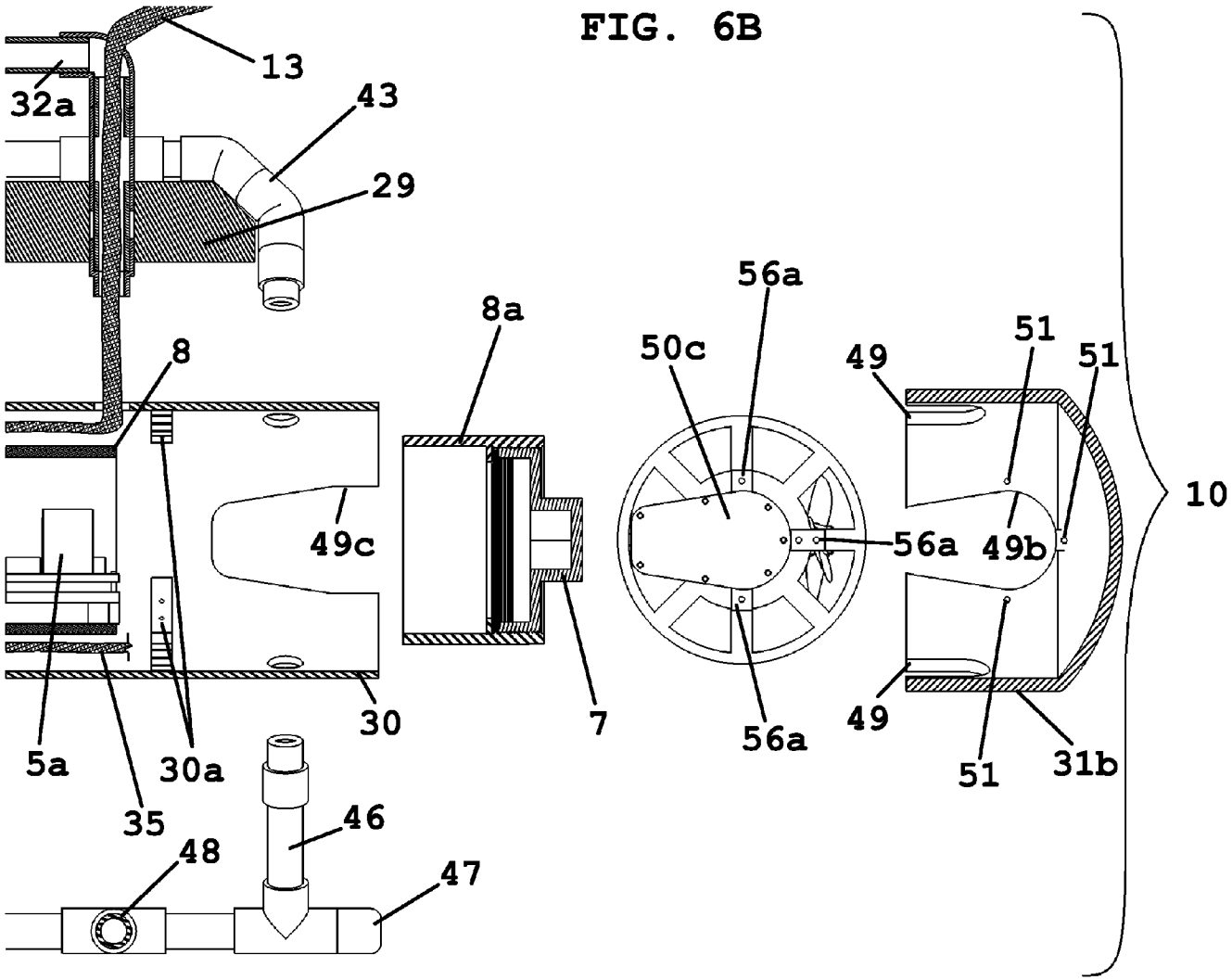
FIG. 6B is a fragmentary exploded longitudinal cross section view of the rear (aft) portion of the exemplary submersible ROV shown in FIG. 6.
Figure 6C:
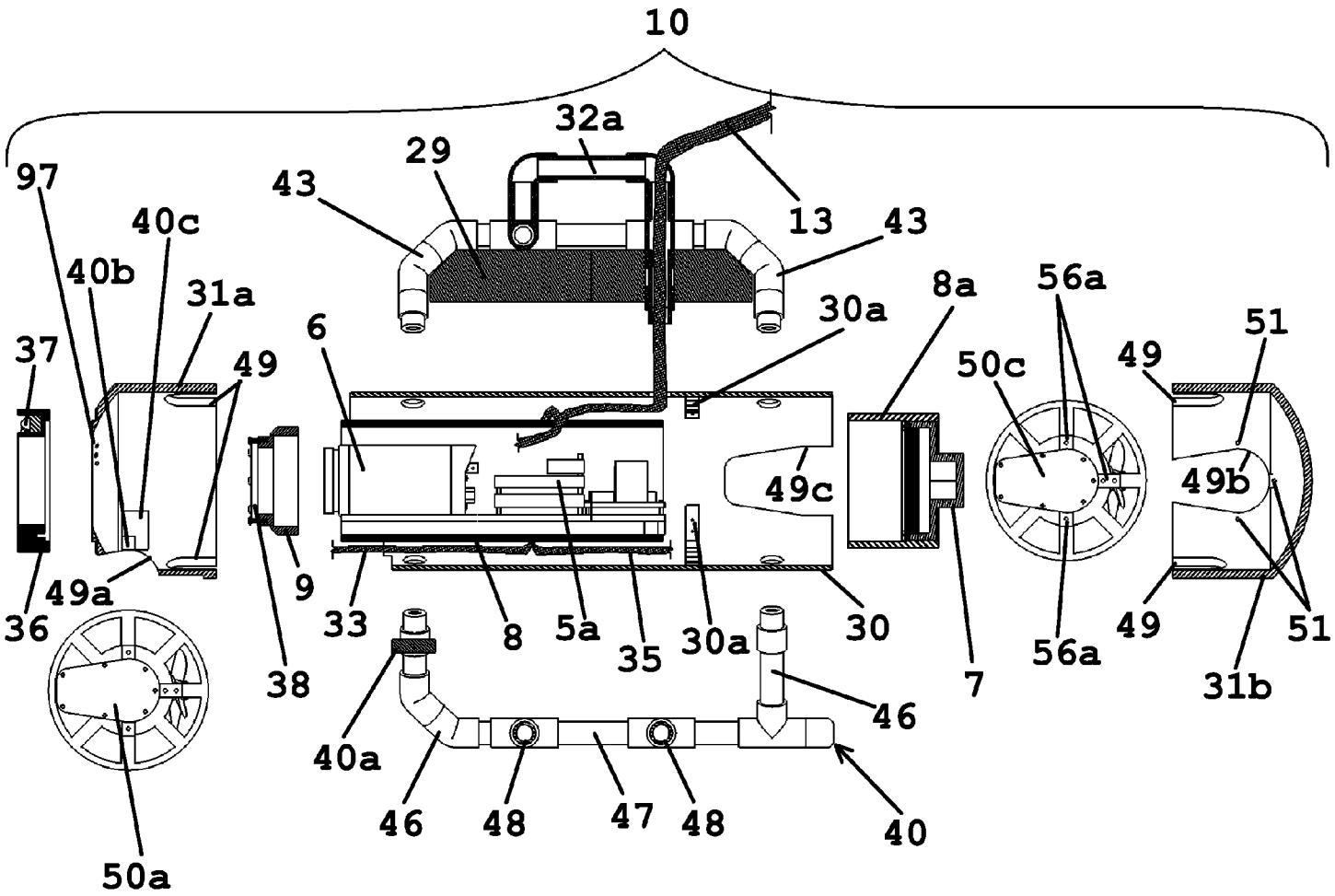
FIG. 6C is an exploded longitudinal cross section view of the exemplary submersible ROV shown in FIG. 6.
Figure 7:
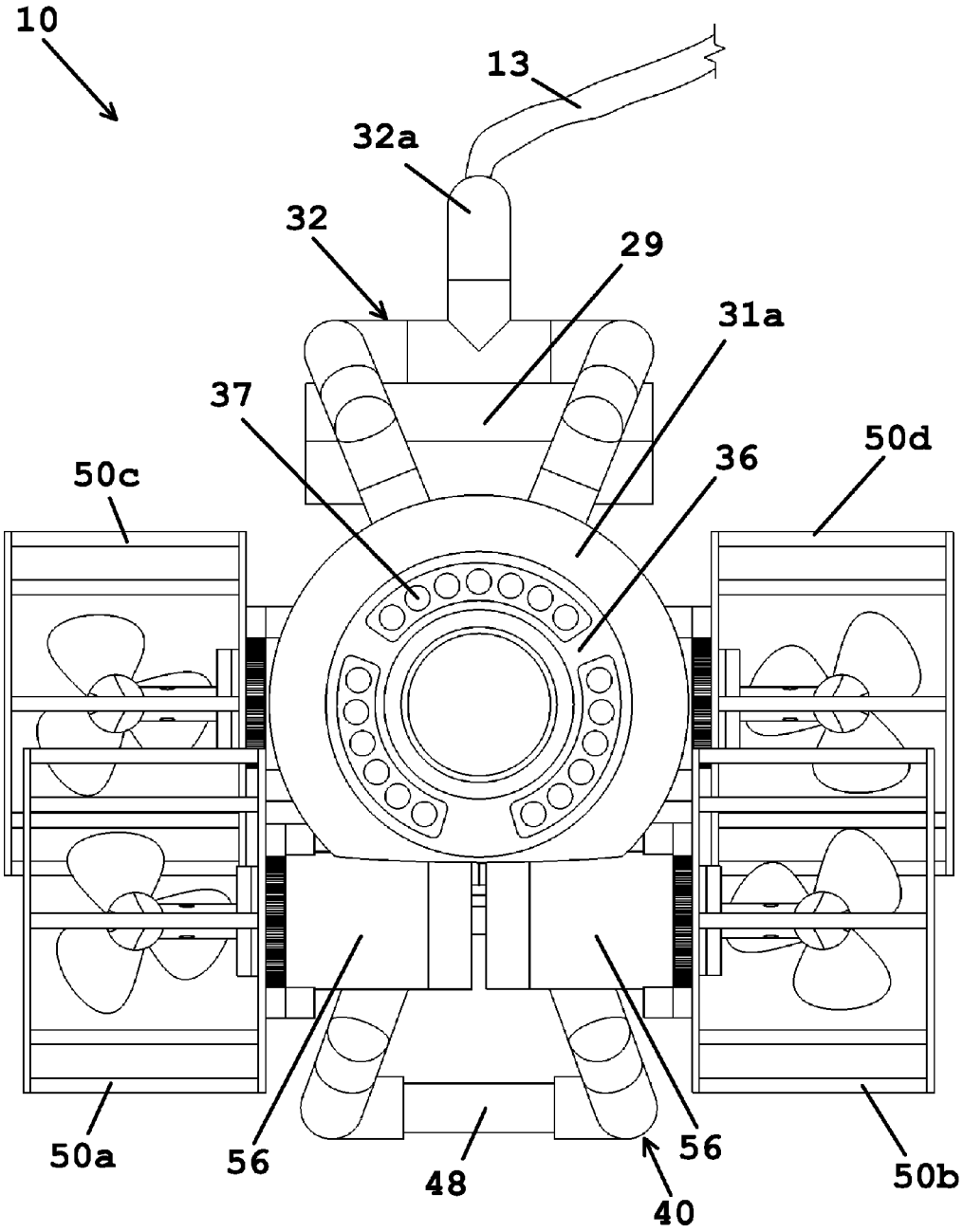
FIG. 7 is an elevation view of the front (fore) end of the exemplary submersible ROV.
Figure 8:
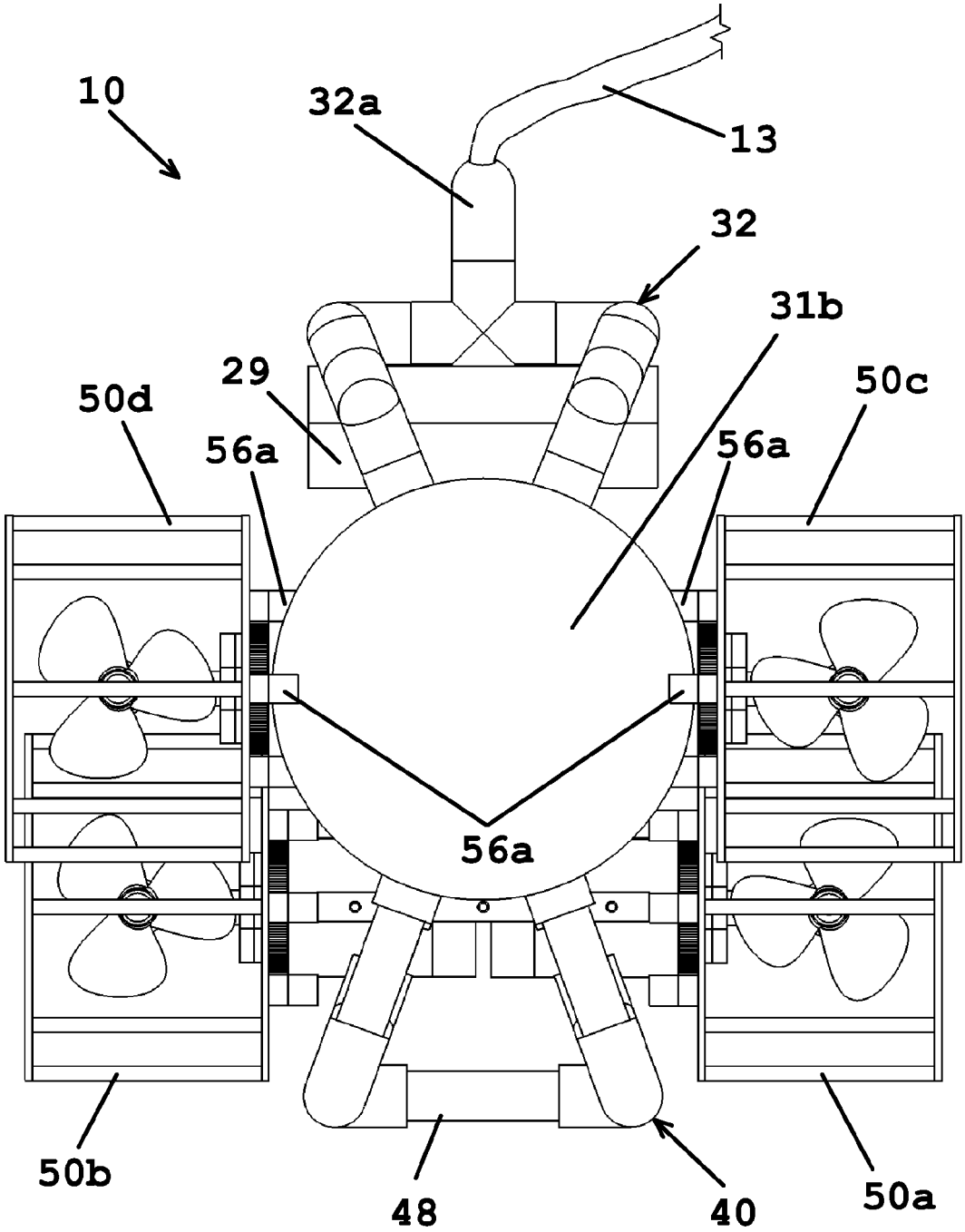
FIG. 8 is an elevation view of the back (aft) end of the exemplary submersible ROV.
Figure 9:
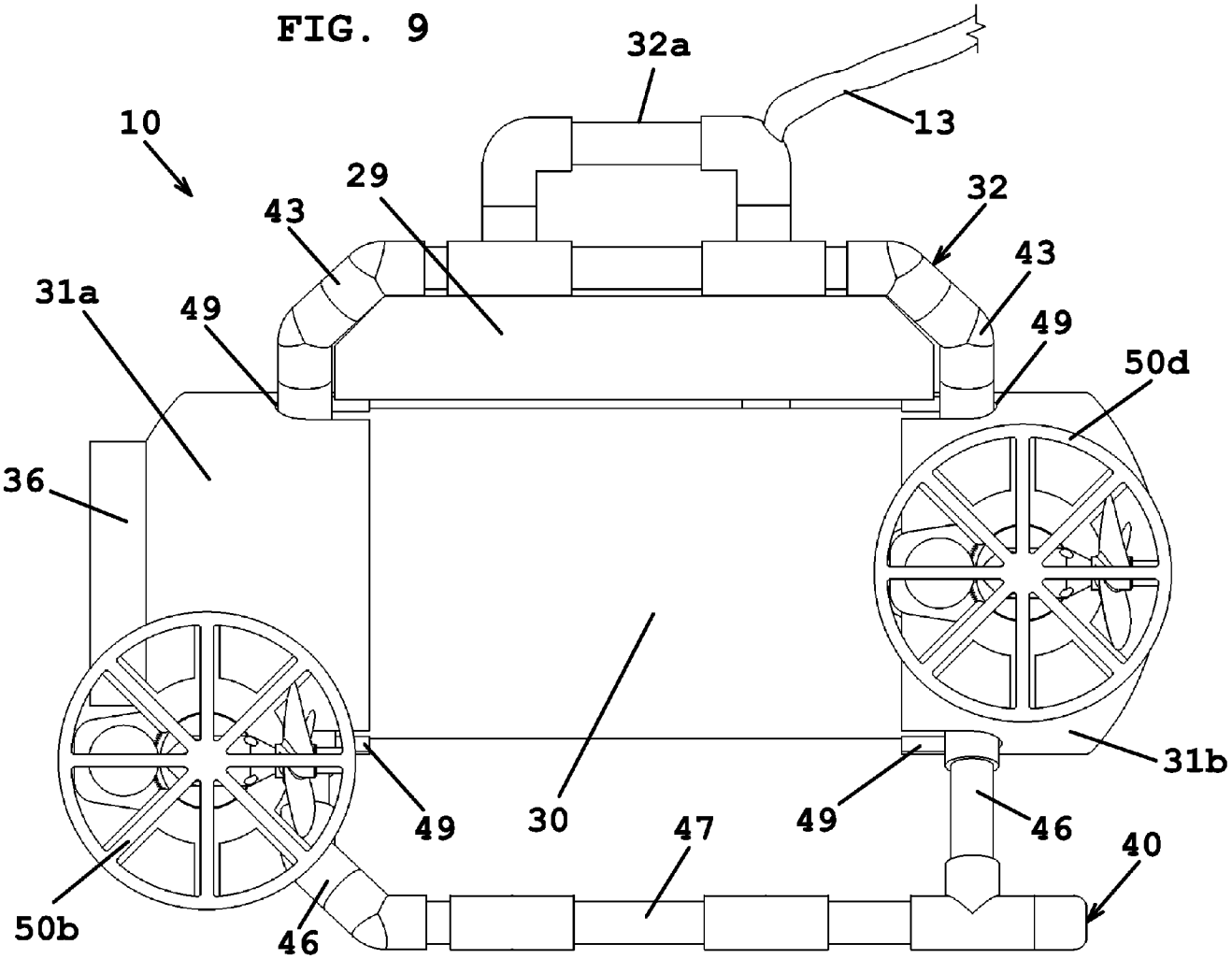
FIG. 9 is a side elevation view of the exemplary submersible ROV.

FIG. 4 is perspective view of an exemplary submersible ROV 10 of the present invention. FIG. 5 is a top view looking down on the exemplary submersible ROV 10 of FIG. 4. FIG. 6 is a longitudinal cross section of the exemplary submersible ROV 10 taken at section line 6-6 of FIG. 5. FIG. 6A is a fragmentary exploded longitudinal cross section view of the forward (fore) portion of the exemplary submersible ROV shown in FIG. 6. FIG. 6B is a fragmentary exploded longitudinal cross section view of the rear (aft) portion of the exemplary submersible ROV shown in FIG. 6. FIG. 6C is an exploded longitudinal cross section view of the exemplary submersible ROV shown in FIG. 6. FIG. 7 is an elevation view of the front (fore) end of the exemplary submersible ROV. FIG. 8 is an elevation view of the back (aft) end of the exemplary submersible ROV. FIG. 9 is a side elevation view of the exemplary submersible ROV.

The submersible ROV 10 includes an outer hull 30 comprising a tubular body, and two removable end caps 31*a*, 31*b*. One removable end cap 31*a* is located at a front (fore) end portion of the outer hull and the other removable end cap 31*b* is located at the back (aft) end portion of the outer hull. In a prototype submersible ROV all of the components of the outer hull are made of polyvinylchloride (PVC). The removable end caps 31*a*. 31*b* have interior diameters that are slightly larger than the exterior diameter of the tubular body of the outer hull 30. In a prototype submersible ROV the tubular body of the outer hull 30 was a length of six inch diameter PVC pipe and the end caps are of a complementary size and are secured to the tubular body with appropriate fasteners such as screws or any other removable fasteners. The outer hull is fixed to and supports upper 32 and lower 40 frame assemblies of the submersible ROV, as well as supporting a number of other components of the submersible ROV. The upper frame assembly 32 includes a carry handle 32*a* that has been described above with respect to the docking of the submersible ROV to the floating ROV. In a prototype submersible ROV 10 the upper frame assembly was made of lengths of one half inch diameter PVC pipe and appropriate PVC fittings. In a prototype submersible ROV 10 the lower frame assembly was made of lengths of one half inch diameter PVC pipe and appropriate PVC fittings. In a prototype the lengths of PVC pipe and angular fittings are fixed to one another by inserting one PVC component into another PVC component and securing them to one another with a suitable adhesive. Four swivel thruster assemblies are fixed to the outer hull. One swivel thruster assembly 50*a* projects from the fore portion of the outer hull on the starboard side of the outer hull. One swivel thruster assembly 50*b* projects from the fore portion of the outer hull on the port side of the outer hull. One swivel thruster assembly 50*c* projects from the aft portion of the outer hull on the starboard side of the outer hull. One swivel thruster assembly 50*d* projects from the aft portion of the outer hull on the port side of the outer hull.

In a prototype submersible ROV the upper frame assembly includes four leg sections 43, two longitudinal sections 44, two cross members 45 connecting the longitudinal sections 44 to one another, and a carry handle 32*a* fixed to the two cross members 45. The leg sections 43 of the upper frame assembly extend through and are fixed to the tubular body of the outer hull 30 as shown in FIG. 6. In a prototype submersible ROV the tether 13 passes through an opening located near an end of the carry handle 32*a* into the interior of the upper frame assembly and through the upper frame assembly and a float 29 into the outer hull 30 and then through a pressure hull 8 as shown in FIG. 6. It is understood that the configuration of the upper frame assembly may be varied in accordance with good engineering practices without departing from the spirit and scope of the invention. The float 29 is secured to a top side of the outer hull 30 by the upper frame assembly 32 as shown in FIG. 6. In a prototype submersible ROV 10 the float 29 is a standard marine grade micro-glass bead closed cell foam material that does not absorb water. The float 29 gives the submersible ROV some rise and helps to keep the submersible ROV stable when the submersible ROV is submerged.

A lower frame assembly 40 is fixed to and supported by the tubular body of the outer hull 30. The lower frame assembly includes four leg sections 46, two longitudinal sections 47, and two cross members 48 connecting the longitudinal sections 47 to one another. It is understood that the configuration of the lower frame assembly may be varied in accordance with good engineering practices without departing from the spirit and scope of the invention. The lower frame assembly 40 is intended to prevent a lower portion of the outer hull 30 from directly impacting submerged objects or the bottom of a body of water. The hollow inside of the longitudinal sections 47 of the lower frame assembly 40 contain buoyancy weights to help balance the submerged ROV and help the ROV to obtain at least close to neutral buoyancy. The leg sections 46 of the lower frame assembly extend through and are fixed to the outer hull 30 as shown in FIG. 6. The end caps 31*a*, 31*b* of the outer hull are provided with leg accommodating notches 49 to accommodate the leg sections 43, 46 of the upper 32 and lower 40 frame assemblies, thereby allowing the end caps 31*a*, 31*b* to be slid onto and off of the tubular body of the outer hull 30.

As best shown in FIGS. 6, 6A and 6C an end portion of the end cap 31*a* located at the front end (fore) portion of the submersible ROV 10 is provided with an opening 97 to facilitate the fixing in the opening of a portion of a circular pressure hull lens housing 9 that is a frame for a pressure hull lens 38 that is a clear window. A circular light fixture housing 36 extends around the opening 97 in the end cap and is disposed exterior of the end cap 31*a*. The light fixture is provided with a light source such as a ring array 37 of light emitting diodes (LEDs). As shown in FIGS. 6-6C a space that will be flooded when the submersible ROV is submerged is disposed between the outer hull 30 and the inner pressure hull 8. The outer hull 30 is not water proof, while the inner pressure hull 8 is water proof. The inner pressure hull contains a camera 6 with a lens of the camera aligned with the pressure hull lens 38. The camera 6 is preferably a video camera capable or receiving control signals for turning the camera on and off and for focusing the lens of the camera via the circuitry presented in FIGS. 19A and B. The control signals originate at a land based or surface vessel based controller as described above. The camera 6 is also capable of generating signals to transmit images through conductors in the tether 13 to a receiver 60 located on the surface of the body of water or on land. An electronics package 5*a* having circuitry shown in FIGS. 19A and B is located inside the inner pressure hull 8 includes circuitry for: generating the location and directional orientation of the ROV and sending such data to a receiver on the surface of the water or land via conductors in the tether 13; receiving control signals for the operation of the four swivel thruster assemblies 50*a*-50*d* and confirming the operation of the swivel thruster assemblies to an operator located on the surface of the water or on land. It is understood that the hardware, circuitry and operation of the electronics package may be varied to suit a designer and user in accordance with good engineering practices without varying from the scope of the present invention.

As best shown in FIGS. 6, 6B and 6C an aft end of the tubular pressure hall 8 slides into a fore end of a pressure hall rear seal housing 8*a*. A water tight seal is made between the tubular pressure hall 8 and the pressure hall rear seal housing 8*a* using for example a suitable adhesive. In an exemplary submersible ROV used a four inch diameter PVC female threaded adapter as the pressure hall rear seal housing 8*a* with a PVC clean out cap 7 threaded into the pressure hall rear seal housing 8*a* in a water tight manner. One or more pressure hull supporting blocks 30*a* are fixed to an interior surface of the outer hull 30 to support the pressure hull 8 in the area of the pressure hall rear seal housing 8*a* and center the pressure hull 8 in the outer hull 30. It is understood that the location of the pressure hull supporting blocks 30*a* may be varied in accordance with good engineering practices without varying from the scope of the present invention.

Figure 19A:
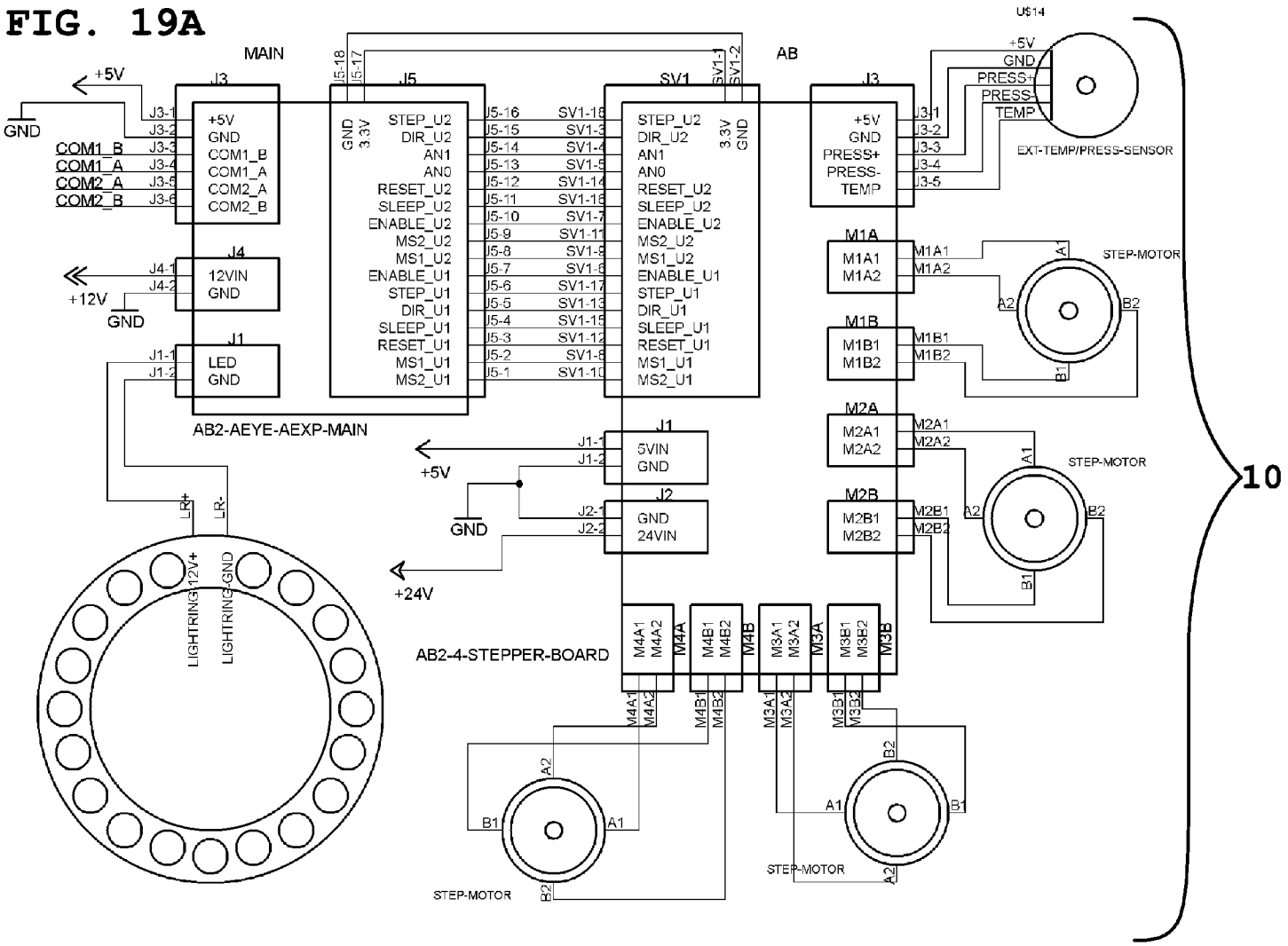
FIGS. 19A and B are a schematic of the electrical circuitry of the exemplary submersible ROV.
Figure 19B:
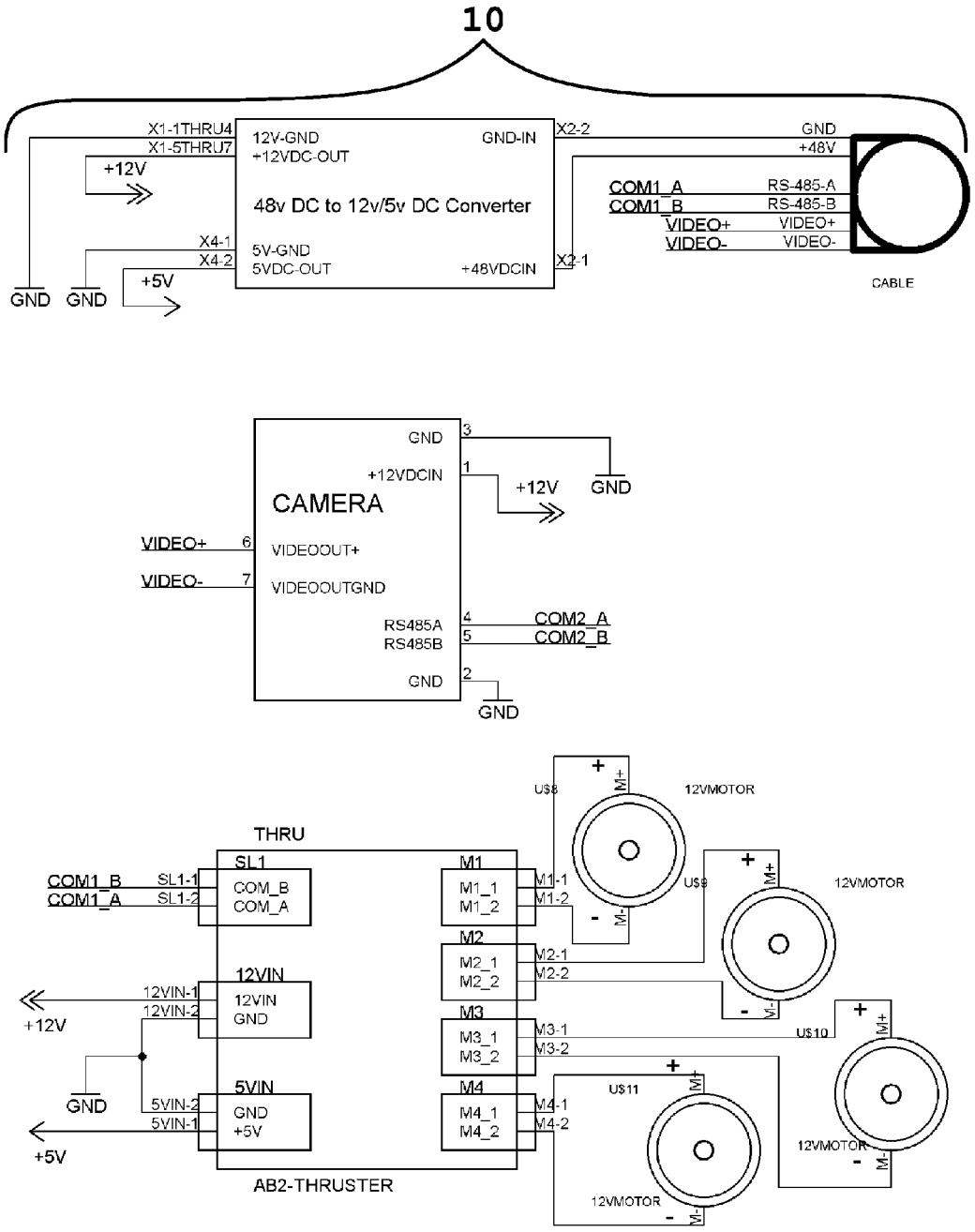

As best shown in FIGS. 6A, 6B and 6C the tether 13 passes through a portal in the handle 32*a* of the upper frame assembly 32 and portals in one of the cross members 45 of the upper frame assembly, then through a passage in the float 29 and another passage in the outer hull 30 into the space between the outer hull and the inner pressure hull 8, then through a passage in the inner pressure hull in a water tight manner. The conductors in the tether are then directed to and in circuit communication with various components of the submersible ROV such as the camera 6 and the electronic package 5*a*. Extension 33 of the tether conducts power and control signals to the fore thruster assemblies 50*a*, 50*b* and extension 35 of the tether conducts power and control signals to the aft thruster assemblies 50*c*, 50*d*. FIGS. 19A and B are a schematic representation of the configuration of electrical conductors and devices in the prototype submersible ROV 10 that may be referred to for details of the electrical configuration.

The submersible ROV 10 is provided with four swivel thruster assemblies. Two of the swivel thruster assemblies 50*a*, 50*b* are located adjacent the end cap 31*a* at the front (fore) end of the submersible ROV 10. Two swivel thruster assemblies 50*c*, 50*d* are located adjacent the end cap 31*b* at the back (aft) end of the submersible ROV. The structure and function of the swivel thruster assemblies will be described below with regards to FIGS. 10-16.

Figure 10:
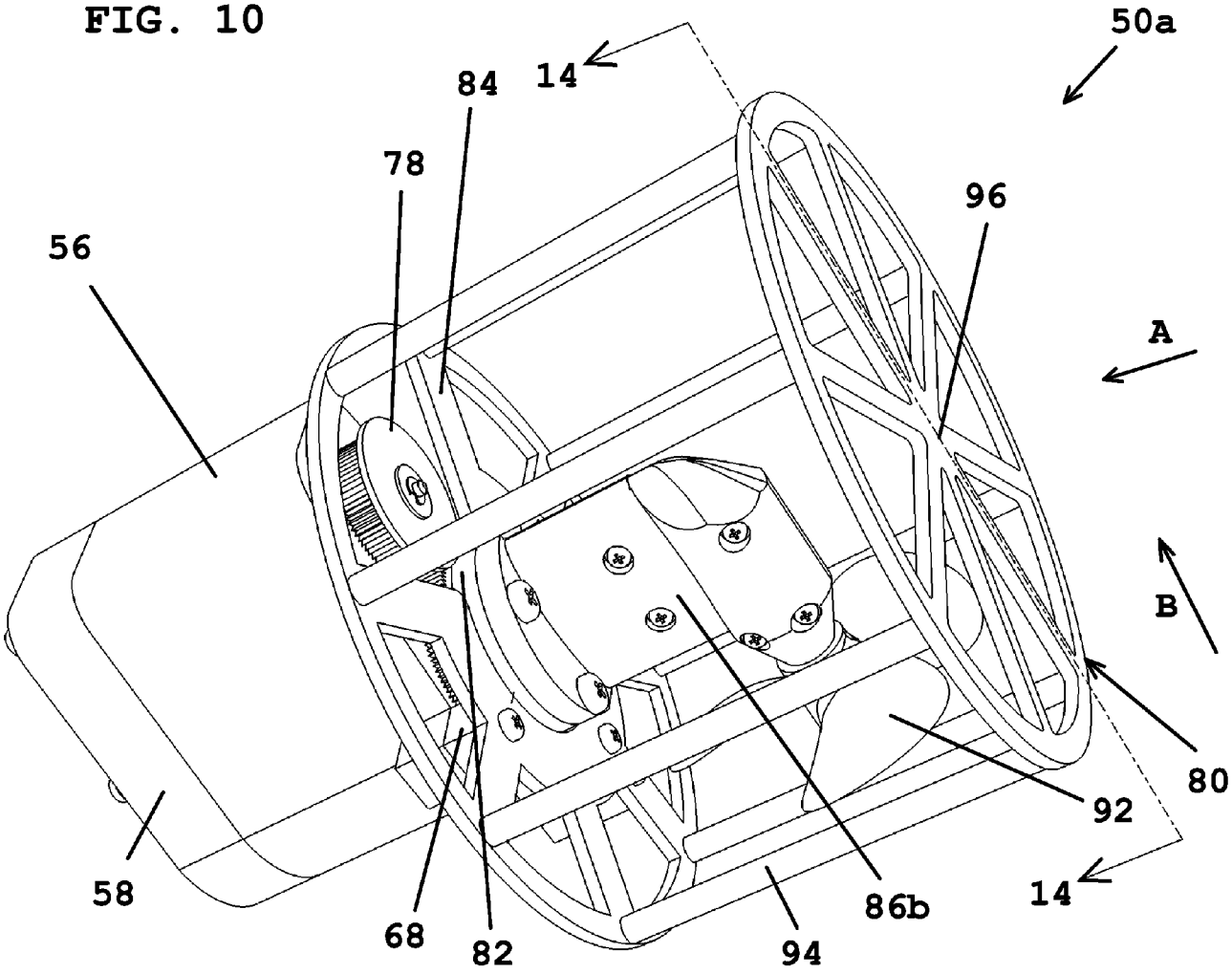
FIG. 10 is a perspective view of an exemplary swivel thruster assembly of a submersible ROV of the present invention.
Figure 11:
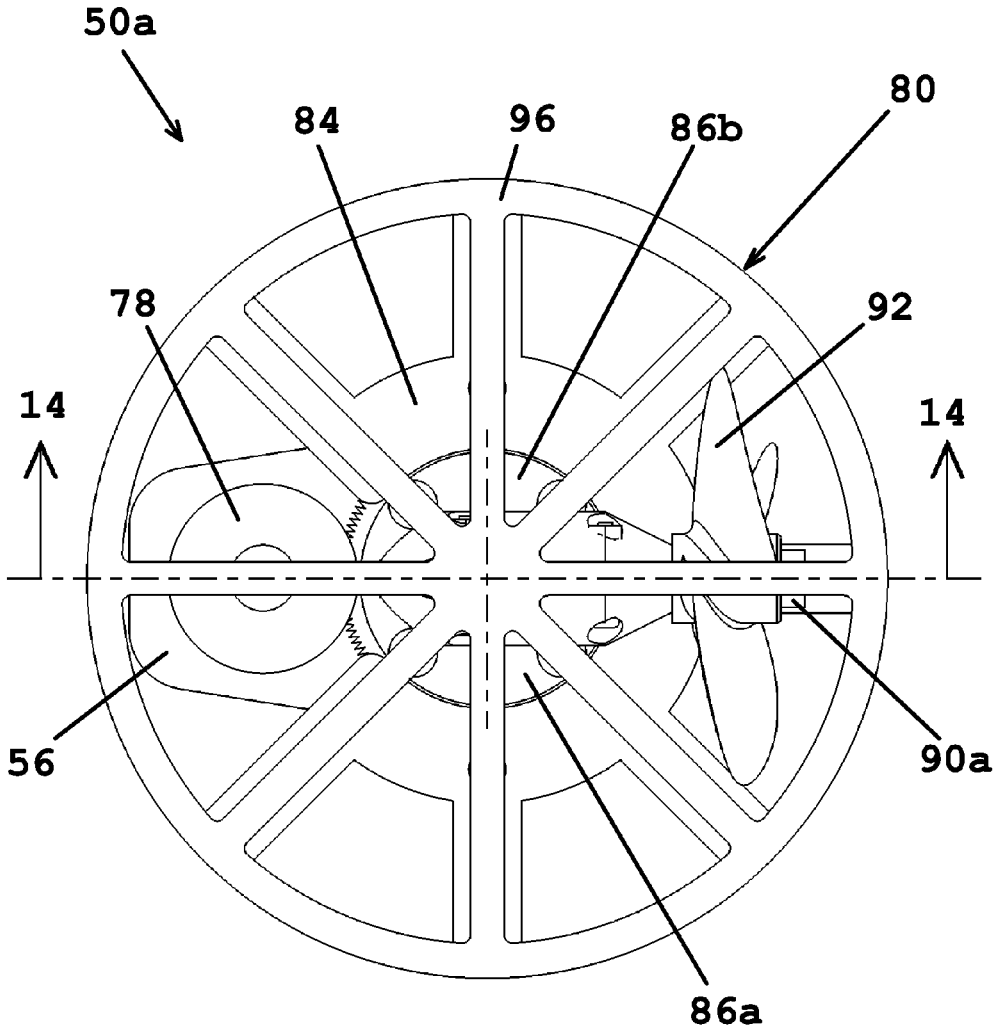
FIG. 11 is an end view of the exemplary swivel thruster assembly of FIG. 10 looking in the direction indicated by arrow A in FIG. 10.
Figure 12:
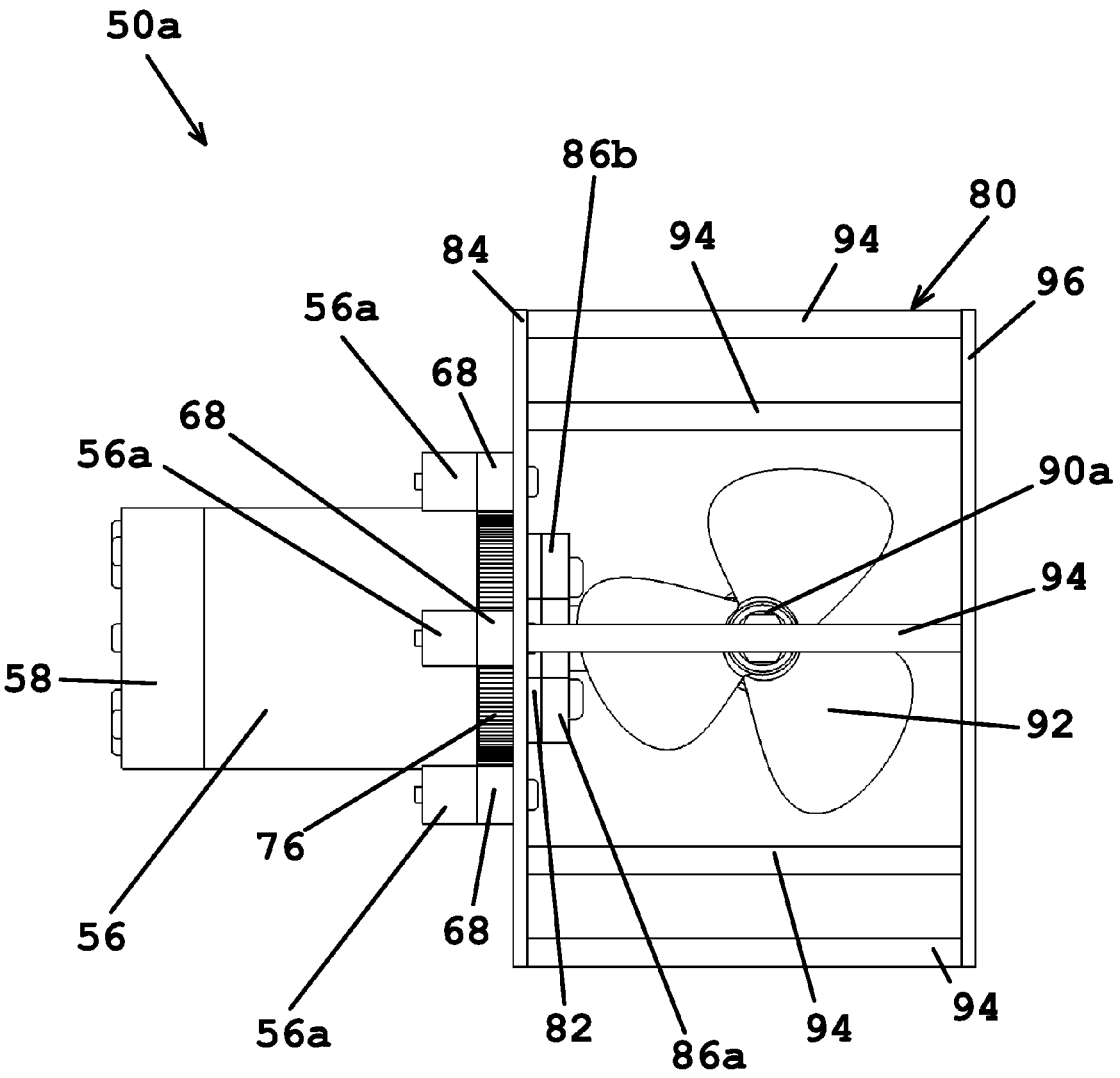
FIG. 12 is a side view of the exemplary swivel thruster assembly of FIG. 10 looking in the direction indicated by arrow B in FIG. 10.
Figure 13:
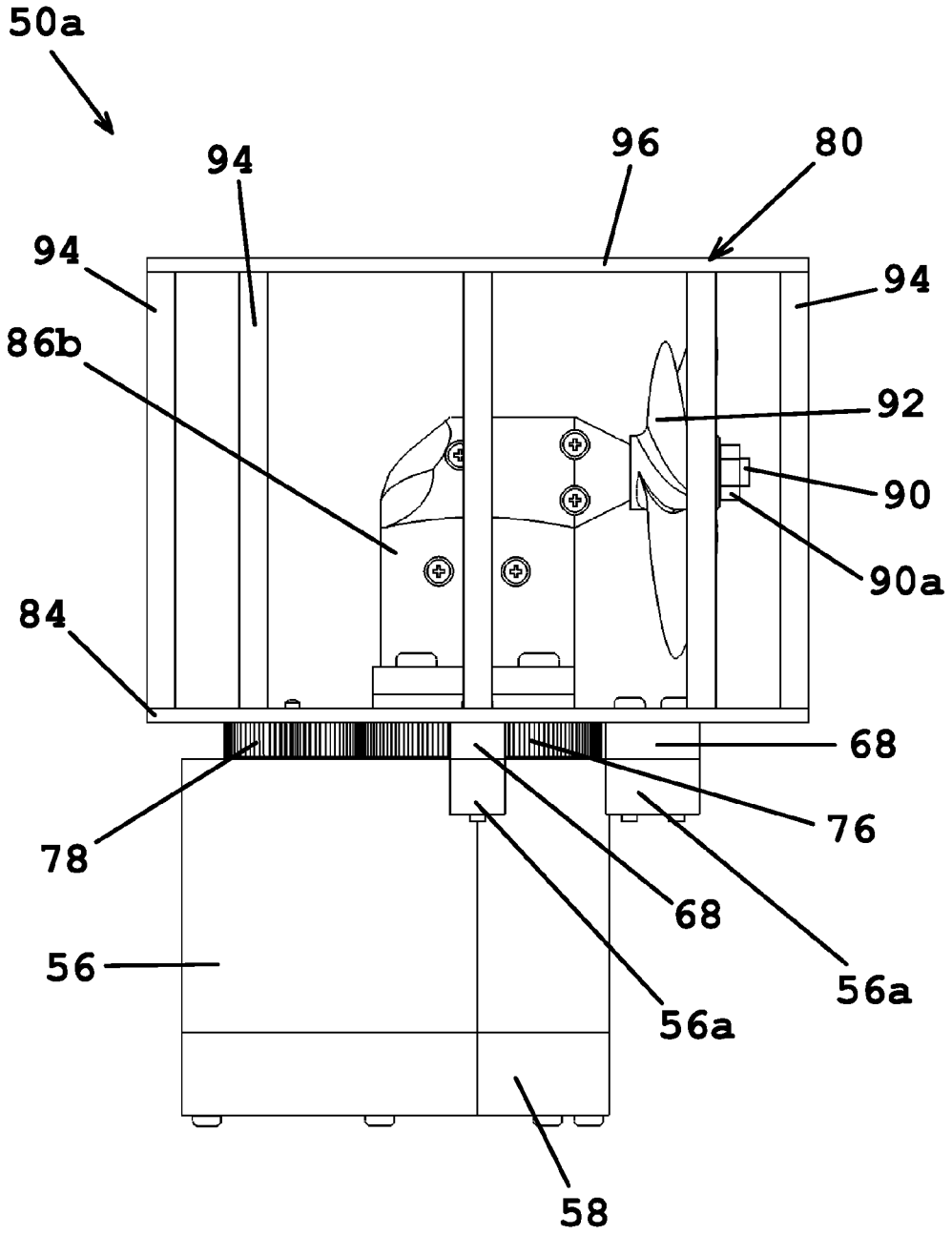
FIG. 13 is a top view of the exemplary swivel thruster assembly of FIG. 10 looking down towards the swivel thruster in an operative orientation as if the swivel thruster assembly were already mounted to a submersible ROV.
Figure 14:
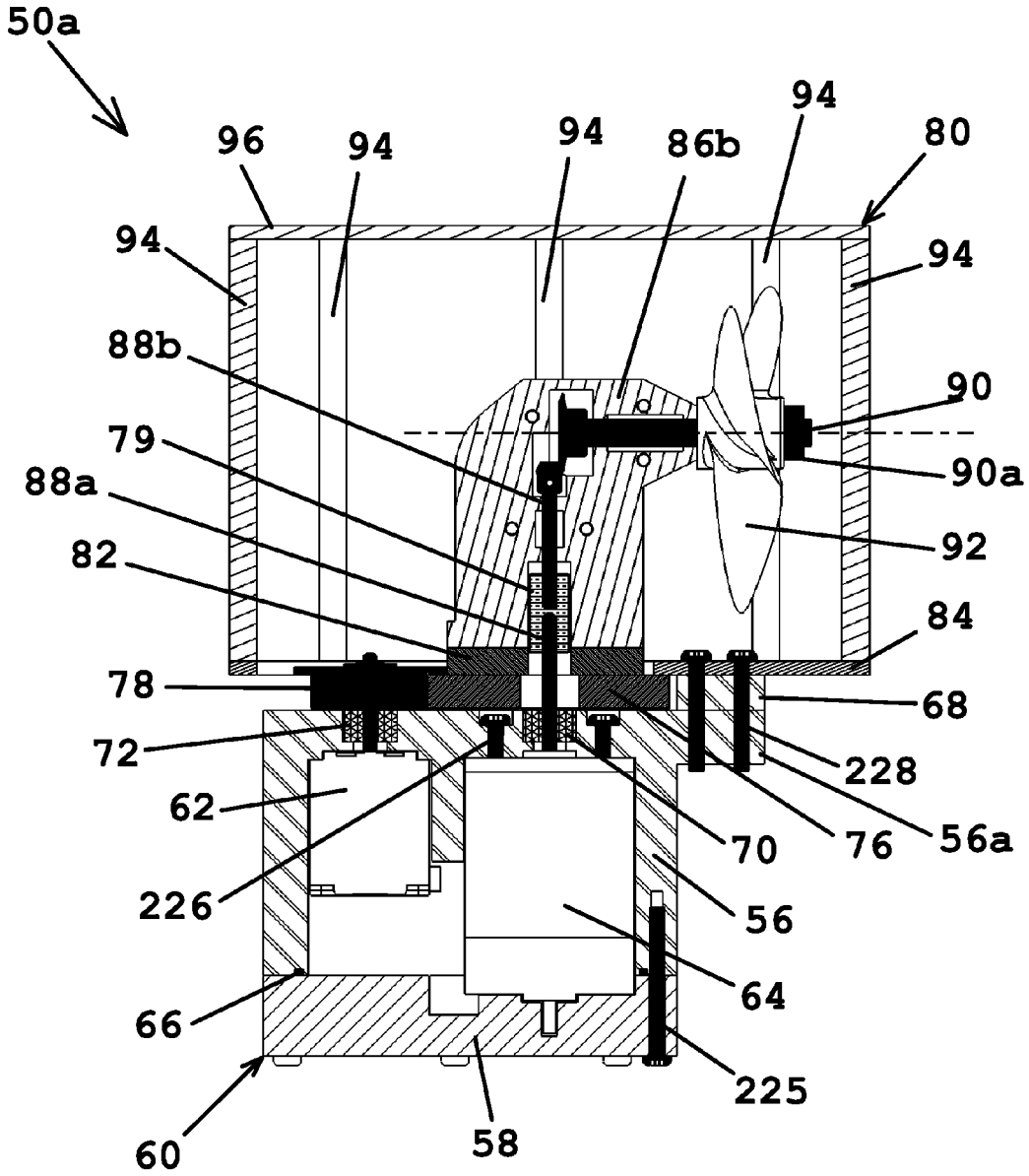
FIG. 14 is a cross section of the exemplary swivel thruster assembly of FIG. 10 taken at line 14-14 in FIG. 10.
Figure 15:
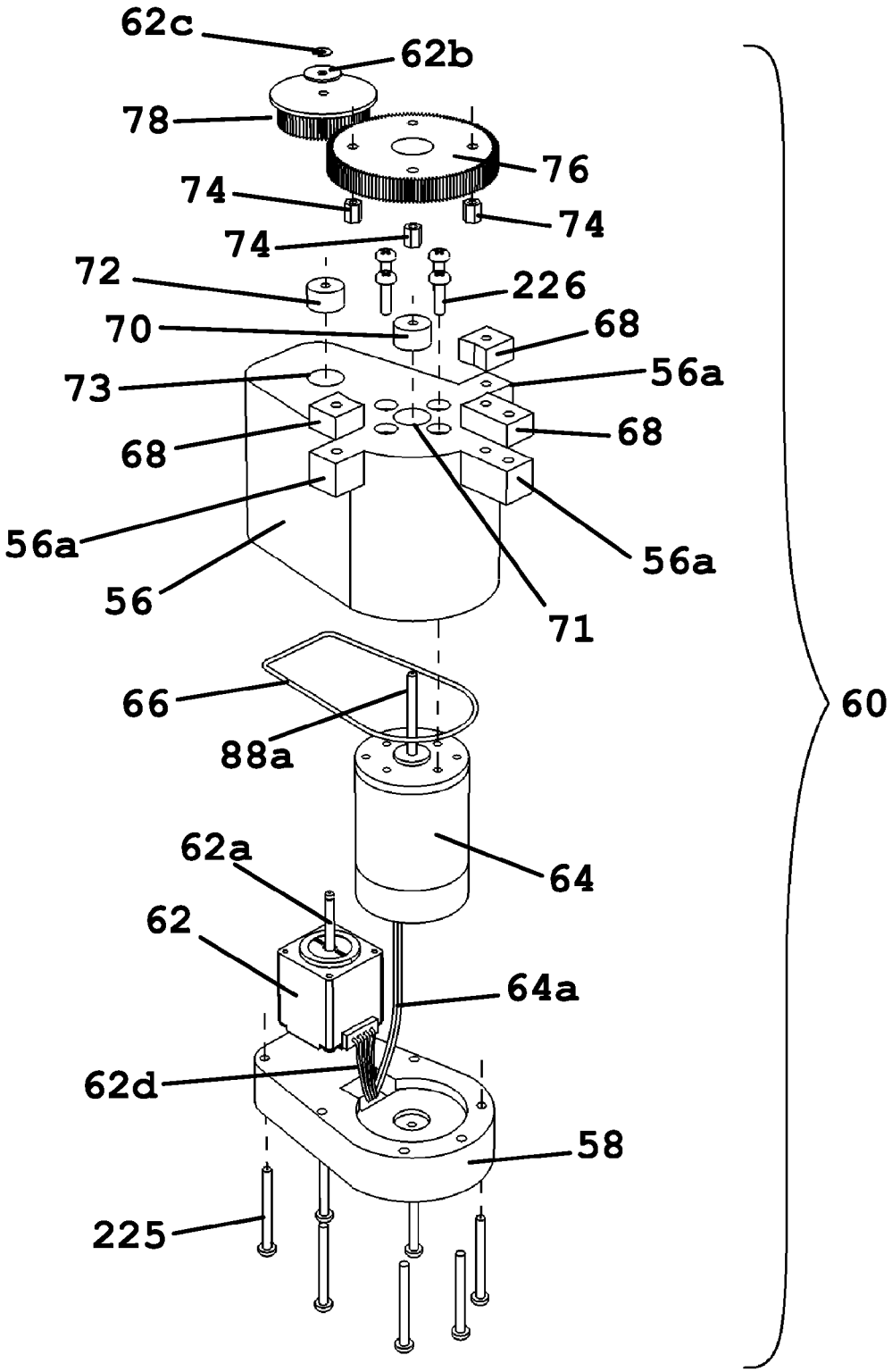
FIG. 15 is an exploded view of a power drive subassembly of the exemplary swivel thruster assembly of FIG. 10.
Figure 16:
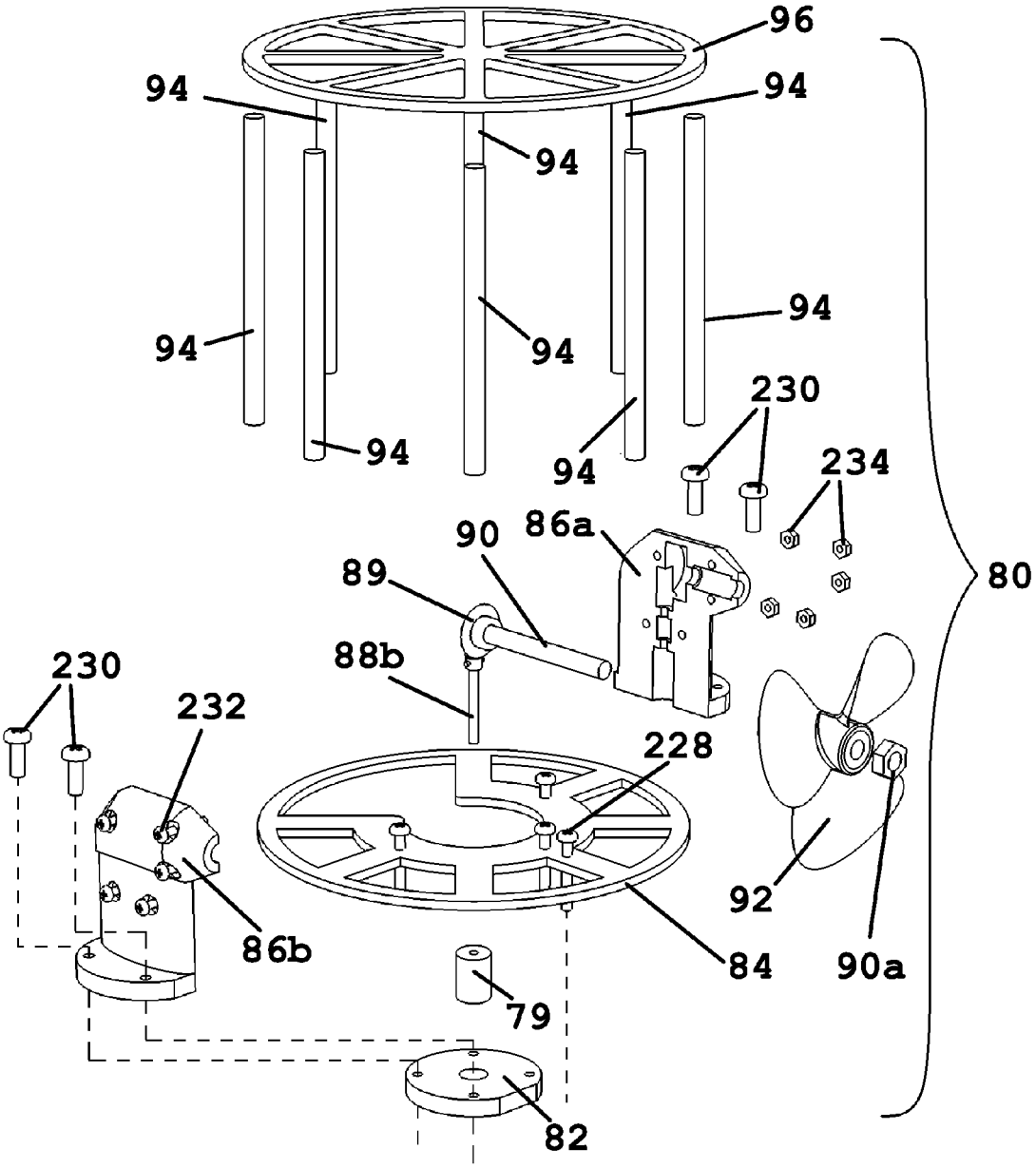
FIG. 16 is an exploded view of a propeller and housing subassembly of the exemplary swivel thruster assembly of FIG. 10.
Figures 17A, 17B, 17C, 17D, 17E, 17F, 17G, 17H:
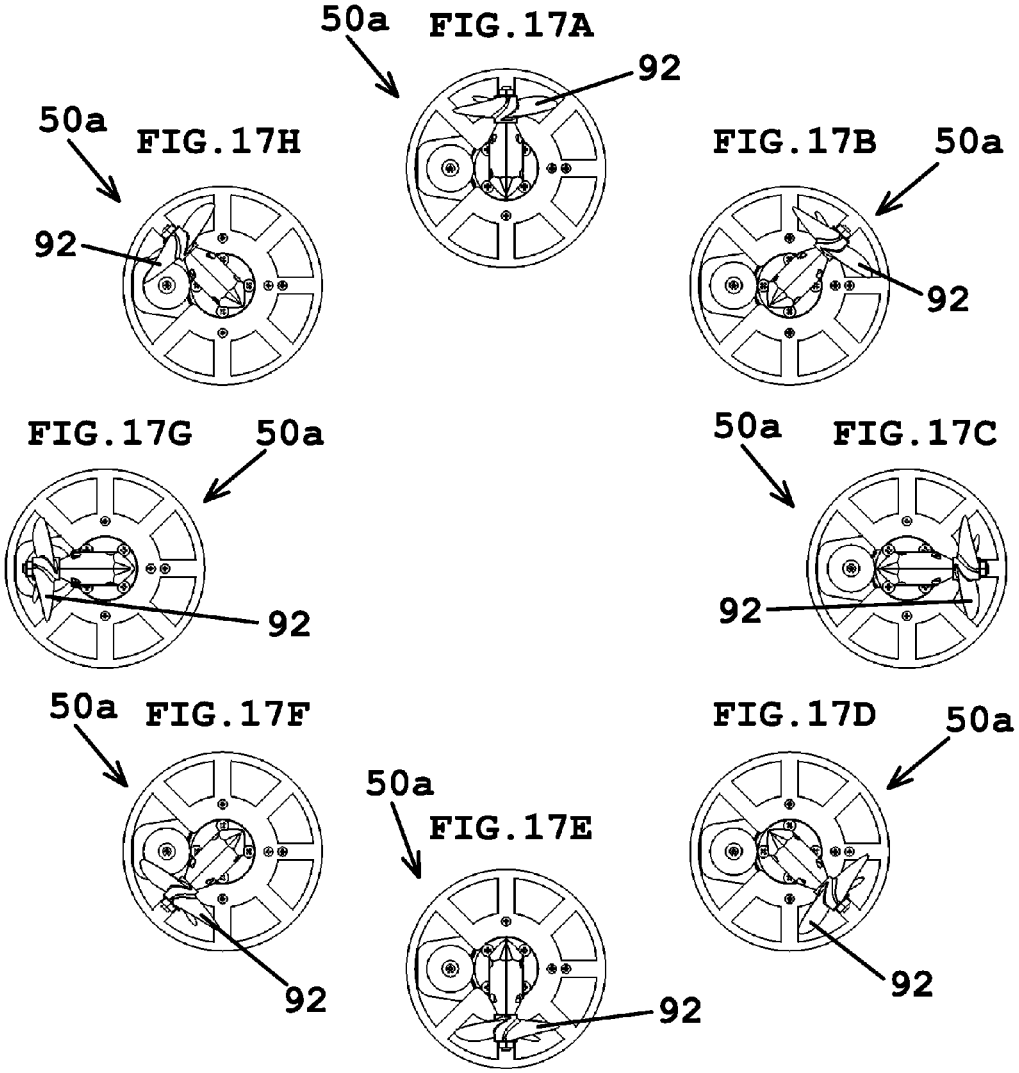
FIGS. 17A-17H are diagrams showing the various possible orientations of the propeller of a 360 degree swivel thruster assembly as a drive support shaft of the swivel thruster assembly is rotated to control the direction of thrust provided by the swivel thruster assembly.
Figure 18:
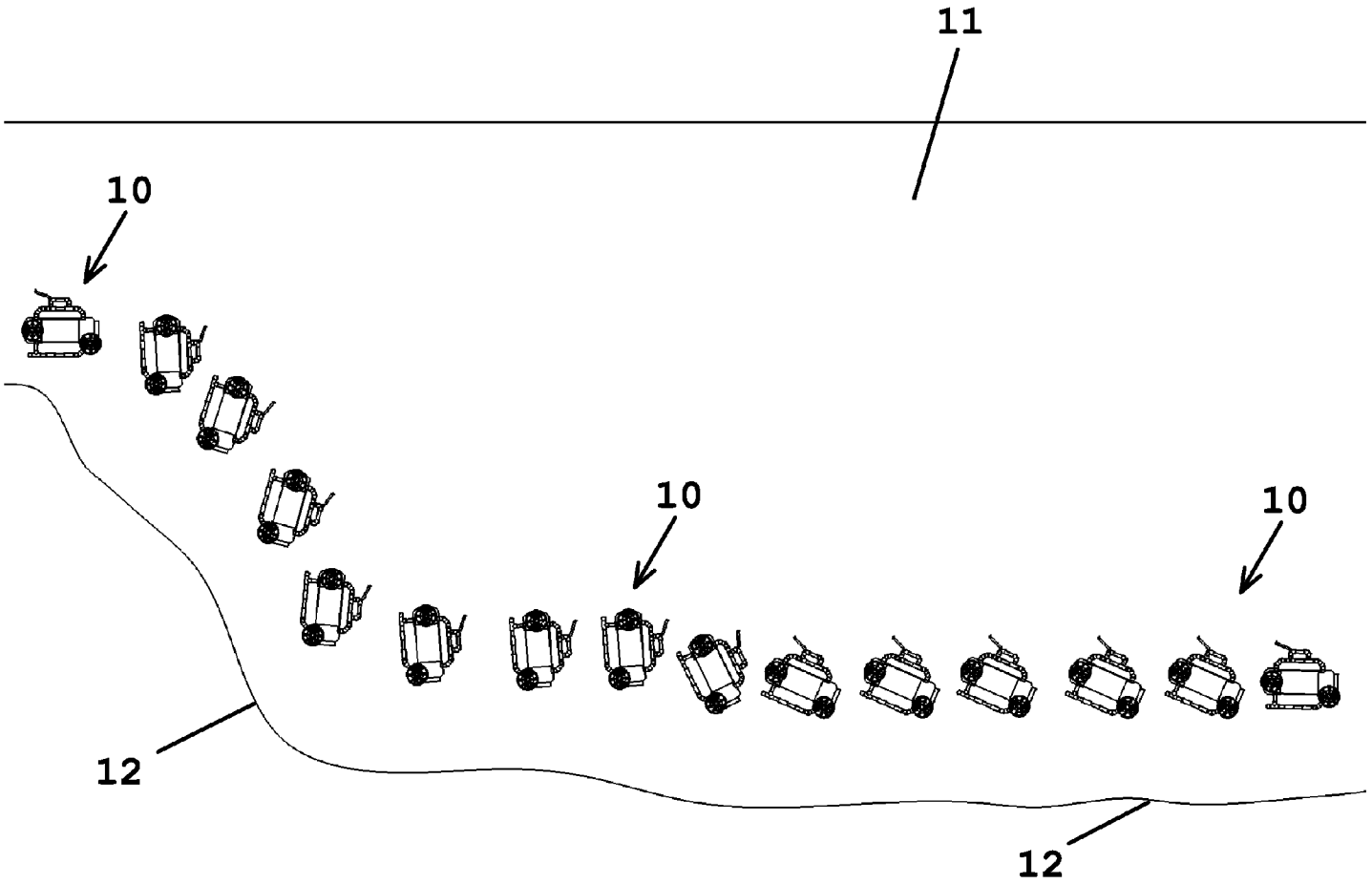
FIG. 18 is a schematic representation of changes of the orientation of a submersible ROV of the present invention as a drive support shaft of the swivel thruster assembly is rotated to control the direction of thrust provided by the swivel thruster assembly.

FIG. 10 is a perspective view of an exemplary swivel thruster assembly 50*a* of a submersible ROV of the present invention. FIG. 11 is an end view of the outboard end of the exemplary swivel thruster 50*a* assembly of FIG. 10 looking in the direction indicated by arrow A in FIG. 10. FIG. 12 is a side view of the exemplary swivel thruster assembly 50*a* of FIG. 10 looking in the direction indicated by arrow B in FIG. 10. FIG. 13 is a top view of the exemplary swivel thruster assembly 50*a* of FIG. 10 looking down towards the swivel thruster in an operative orientation as if the swivel thruster assembly were already mounted to a submersible ROV. FIG. 14 is a cross section of the exemplary swivel thruster 50*a* assembly of FIG. 10 taken at line 14-14 in FIG. 10. FIG. 15 is an exploded view of a power drive subassembly 60 of the exemplary swivel thruster assembly of FIG. 10. FIG. 16 is an exploded view of a propeller and housing subassembly 80 of the exemplary swivel thruster assembly of FIG. 10.

The exemplary swivel thruster assembly 50*a* in FIGS. 10-16 is the front (fore) right (port) swivel thruster assembly of the exemplary submersible ROV 10 shown in FIGS. 4-9. It is to be understood that all four of the swivel thruster assemblies 50*a*-50*d* have substantially the same construction and operate in substantially the same manner. Each of the swivel thruster assemblies 50*a*-50*d* comprises a swivel thruster drive assembly 60, shown in an exploded view in FIG. 15, and a swivel thruster propeller assembly 80, shown in an exploded view in FIG. 16.

The swivel thruster drive assembly 60 includes a swivel thruster housing cap 58 located at the inboard end of the swivel thruster drive assembly 50*a*. A swivel thruster housing body 56 is fixed to the swivel thruster housing cap 58 to provide a water tight enclosure that contains, as shown in FIGS. 14 and 15, an electric stepper motor 62 and an electric propulsion motor 64. The electric stepper and propulsion motors 62, 64 are provided with electric current via appropriate conductors 62*d* and 64*a*. The wiring is best understood by referring to FIGS. 19A and B which is a schematic representation of the configuration of electrical conductors in the prototype submersible ROV 10. The swivel thruster housing body 56 is fixed to the swivel thruster housing cap 58 using a plurality of threaded fasteners 225 with a thruster body seal 66 that may be in the form of an O ring disposed at the interface of the swivel thruster housing body and the swivel thruster housing cap for watertight integrity.

As best shown in FIGS. 6A, 7 and 12 the end cap 31*a* located at the front end (fore) of the submersible ROV 10 is provided with a thruster accommodating notch 49*a* and a lateral bar 40*b* is fixed in place using at least one mounting block 40*c* at each end of the lateral bar 40*b*. A collar 40*a* is fixed to each of the fore leg sections 46 adjacent the outer hull 30. Mounting tabs 56*a* of the swivel thruster housing body 56 are fixed to the lateral bar 40*b* and the collar 40*a* by appropriate fasteners to secure each of the fore swivel thruster drive assemblies 50*a*, 50*b* to the fore outer hull end cap 31*a* oriented as best shown in FIG. 7. It is understood that any other mounting system for mounting the fore swivel thruster drive assemblies to the submersible ROV may selected in accordance with good engineering practices may be used without varying from the scope of the invention.

As best shown in FIGS. 6B, 8 and 12 the end cap 31*b* located at the back end (aft) of the submersible ROV 10 is provided with a pair of thruster accommodating notches 49*b*. The outer hull 30 is provided with a pair of thruster accommodating notches 49*c* that are complementary to and aligned with the thruster accommodating notches 49*b* of the aft end cap 31*b* to receive the assembled swivel thruster housing cap 58 and swivel thruster housing body 56 when the aft end cap 31*b* is slid onto the outer hull 30. Mounting tabs 56*a* of the swivel thruster housing body 56 are fixed to the aft end cap 31*b* using appropriate threaded fasteners and nuts that extend through passages in the mounting tabs 56*a* of the swivel thruster housing body 56 and thruster mounting holes 51 in the aft end cap 31*b*. That is to say, the assembled swivel thruster housing cap 58 and swivel thruster housing body 56 are disposed almost entirely within the aft end cap and outer hull 30 as best appreciated by referring to FIG. 8. It is understood that any other mounting system for mounting the aft swivel thruster drive assemblies to the submersible ROV may selected in accordance with good engineering practices may be used without varying from the scope of the invention. In FIG. 8 which is looking towards the back end (aft) of the submersible ROV the aft swivel thruster drive assemblies 50*c*, 50*d* are shown disposed higher than the fore swivel thruster drive assemblies 50*a*, 50*b* which provides efficient operation by preventing interfering thrust and cavitation from the fore and aft propellers.

Figure 4A:
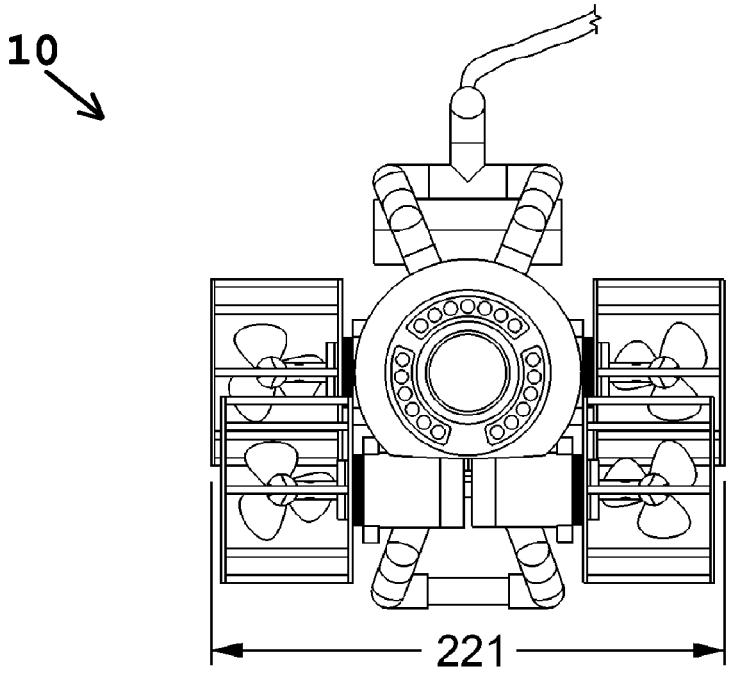
FIG. 4A is a front (fore) view of the exemplary submersible ROV of the present invention with exemplary dimensions indicated thereon.
Figure 4B:
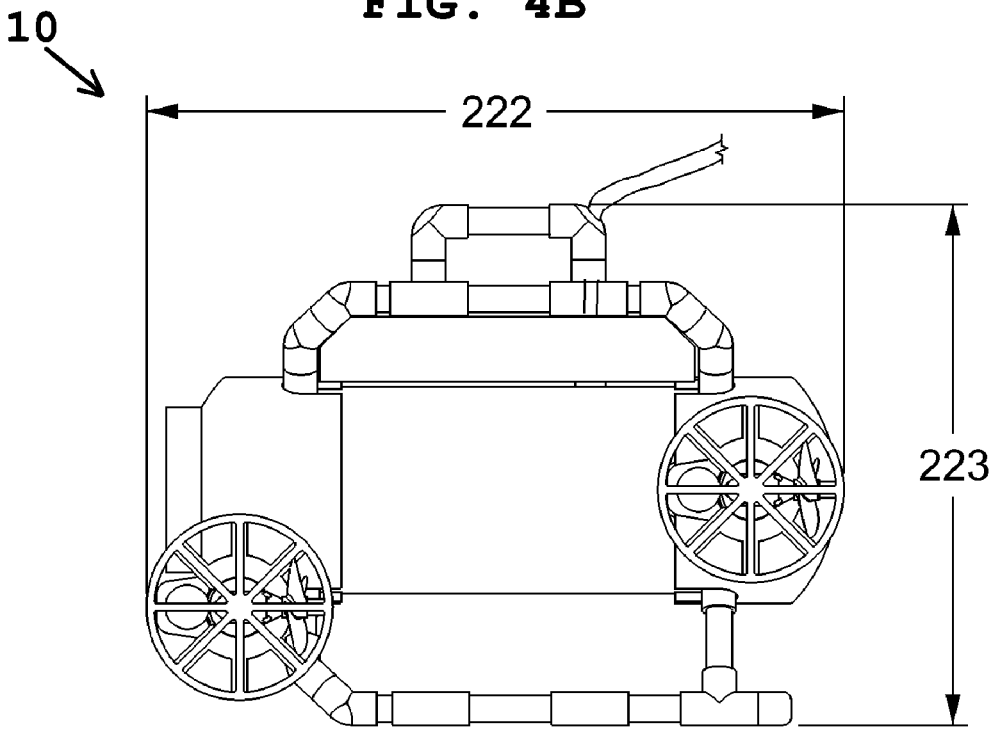
FIG. 4B is a side view of the exemplary submersible ROV of the present invention with exemplary dimensions indicated thereon.

Exemplary dimensions of a prototype submersible ROV 10 can best be presented with reference to FIGS. 4A and 4B wherein FIG. 4A is a front (fore) view of the exemplary submersible ROV 10 and FIG. 4B is a side view of the exemplary submersible ROV 10. A prototype submersible ROV 10 has a width (beam) 221 of about one foot and four and one half inches. A prototype submersible ROV 10 has an overall length 222 of about one foot and ten and one quarter inches. A prototype submersible ROV 10 has an overall height 223 of about one foot and four and three quarter inches.

As best shown in FIGS. 14 and 15, a rotatable shaft 62*a* is driven by the electric stepper motor 62. The rotatable shaft 62*a* extends through a stepper motor seal 72 that is snuggly fitted in an opening 73 in an outboard end of the swivel thruster housing body 56 whereby a portion of the rotatable shaft 62*a* is located outboard of the swivel thruster housing body 56. A stepper motor gear 78 is fixed to the rotatable shaft 62*a* using a flat washer 62*b* and a lock washer 62*c* whereby the stepper motor gear is rotated when the rotatable shaft 62*a* is rotated by the stepper motor 62.

As best shown in FIGS. 14 and 15, the electric propulsion motor 64 is fixed to the swivel thruster housing body 56 by at least two threaded fasteners 226. A rotatable shaft 88*a* is driven by the electric propulsion motor 64. The rotatable shaft 88*a* that is driven by the electric propulsion motor 64 extends through a propulsion motor seal 70 that is snuggly fitted in an opening 71 in an outboard end of the swivel thruster housing body 56 whereby a portion of the rotatable shaft 88*a* that is driven by the electric propulsion motor 64 is located outboard of the swivel thruster housing body 56. The rotatable shaft 88*a* that is driven by the electric propulsion motor 64 extends freely through a central passage of a propeller drive assembly positioning gear 76 without interacting with the propeller drive assembly positioning gear 76. The propeller drive assembly positioning gear 76 is provided with a plurality of threaded bushings 74 that are used for mounting a thruster drive gear housing 86*a*, 86*b* (shown in FIG. 16) in a manner that will be explained in detail below. The propeller drive assembly positioning gear 76 is caused to rotate by the stepper motor gear 78 to change the orientation of the propeller in a manner that will be explained in detail below.

As best shown in FIGS. 14 and 16, the propeller and housing subassembly 80 is fixed to the swivel thruster drive assembly 60 located outboard of the swivel thruster drive assembly 60. An inboard propeller guard plate 84 is secured to the swivel thruster housing body 56 by a plurality of threaded fasteners 228 with the stepper motor gear 78, the propeller drive assembly positioning gear 76, and at least one spacer 68 disposed intermediate of the inboard propeller guard plate 84 and the swivel thruster housing body 56. A spacer plate 82 is located adjacent to and outboard of the propeller drive assembly positioning gear 76. The rotatable shaft 88*a* that is driven by the electric propulsion motor 64 extends freely through a central passage of the spacer plate 82 without interacting with the spacer plate 82. The rotatable shaft 88*a* that is driven by the electric propulsion motor 64 is attached by threads, for example at least one set screw, to an interior passage of a coupler 79. A rotatable shaft extension 88*b* is attached by threads, for example at least one set screw, to the interior passage of the coupler 79. The rotatable shaft extension 88*b* is connected to a propeller drive shaft 90 by a right angle power transmission gear 89. A propeller 92 is mounted on the propeller shaft 90 and is secured to the propeller shaft in an appropriate manner such as by a threaded nut 90*a*. That is to say, the rotatable shaft 88*a* that is driven by the electric propulsion motor 64, the coupler 79 and the rotatable shaft extension 88*b* are all rotatable as a unit within a central passage in a thruster drive gear housing 86*a*, 86*b*. The two halves 86*a*, 86*b* of the thruster gear drive housing are fixed to one another by a plurality of threaded fasteners 232 and mating nuts 234 that are threaded onto the threaded fasteners 232. Referring to FIG. 15 in conjunction with FIG. 16, threaded fasteners 230 extend through flanges of the thruster gear drive housing 86*a*, 86*b* then through aligned passages in the spacer plate 82 and are threaded into the threaded bushings 74 associated with the propeller drive assembly positioning gear 76 whereby the thruster drive gear housing 86*a*, 86*b* rotates when the propeller drive assembly positioning gear 76 is caused to rotate when the stepper motor gear 78 is rotated by the stepper motor 62.

An outboard propeller guard plate 96 is secured to the inboard propeller guard plate 84 by a plurality of propeller guard bars 94. In an exemplary prototype submersible ROV the inboard end of each propeller guard bar 94 was fixed to the inboard propeller guard plate 84 using an adhesive and the outboard end of each propeller guard bar 94 fixed to the outboard propeller guard plate 96 by adhesive also, but it is believed to be preferable to fix the outboard end of each propeller guard bar 94 to the outboard propeller guard plate 96 in a manner such as using threaded fasteners to facilitate disassembly. It is understood that the propeller guard bars may be fixed to the inboard and outboard propeller guard plates in any suitable manner selected in accordance with good engineering practice without deviating from the scope of the present invention.

Using the stepper motor 62 the propeller shaft 90 can be rotated 360 degrees around the drive shaft 88*a*, 88*b* to position the propeller 92 of the exemplary swivel thruster assembly 50*a* in a variety of possible orientations as shown for example in FIGS. 17A-17H to control the direction of thrust provided by the swivel thruster assembly. Each of the swivel thruster assemblies 50*a*, 50*b*, 50*c*, 50*d* may be operated independently of the other swivel thruster assemblies to cause s submersible ROV to move in a manner that emulates the movement of a human diver as shown for example in FIG. 18 which is a schematic representation of changes of the orientation of a submersible ROV of the present invention as the propeller shafts of the swivel thruster assemblies are rotated independently to control the directions of thrust provided by the swivel thruster assemblies.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense. It is also to be understood that the following claims are intended to cover all of the generic and specific features of the invention herein described, and all statements of the scope of the invention which, as a matter of language, might be said to fall there between.

What is claimed is:

1. A submersible remotely operated vehicle comprising:

(a) an outer hull and an inner hull located inside the outer hull, the outer hull having a fore portion and an aft portion, and a starboard side and a port side; and (b) four swivel thruster assemblies fixed to the outer hull, one swivel thruster assembly projecting from the fore portion of the outer hull on the starboard side of the outer hull, one swivel thruster assembly projecting from the fore portion of the outer hull on the port side of the outer hull, one swivel thruster assembly projecting from the aft portion of the outer hull on the starboard side of the outer hull, and one swivel thruster assembly projecting from the aft portion of the outer hull on the port side of the outer hull, and the two swivel thruster assemblies fixed to the fore portion of the outer hull are located at a first height on the outer hull while the two swivel thruster assemblies fixed to the aft portion of the outer hull are located at a second height on the outer hull, the first and second heights being unequal; each swivel thruster assembly comprising an electric propulsion motor with a propulsion motor drive shaft extending from the electric propulsion motor, the propulsion motor drive shaft communicating via right angle gears with a propeller shaft oriented perpendicular to the propulsion motor drive shaft to rotate the propeller shaft and a propeller fixed to the propeller shaft.

2. The submersible remotely operated vehicle of claim 1 wherein each swivel thrust assembly further comprises an electric stepper motor with a stepper motor drive shaft extending from the stepper motor, the stepper motor drive shaft driving gears that rotate the propeller shaft and propeller around an axis of the propulsion motor drive shaft.

3. The submersible remotely operated vehicle of claim 2 wherein the propeller shaft and propeller of each swivel thruster assembly may be rotated three hundred and sixty degrees around the axis of the propulsion motor drive shaft.

4. The submersible remotely operated vehicle of claim 3 wherein the propeller shaft and propeller of each swivel thruster assembly may be rotated three hundred and sixty degrees around the axis of the propulsion motor drive shaft.

5. The submersible remotely operated vehicle of claim 2 further comprising a tether provided with conductors for conducting control signals from a remotely located controller to a control circuit located inside inner hull that communicates with the electric propulsion motor and the electric stepper motor of each swivel thruster assembly whereby the electric propulsion motor and the electric stepper motor of each swivel thruster assembly is controlled independent of the electric propulsion motor and the electric stepper motor of each of the other swivel thruster assemblies.

6. The submersible remotely operated vehicle of claim 3 further comprising a tether provided with conductors for conducting control signals from a remotely located controller to a control circuit located inside inner hull that communicates with the electric propulsion motor and the electric stepper motor of each swivel thruster assembly whereby the electric propulsion motor and the electric stepper motor of each swivel thruster assembly is controlled independent of the electric propulsion motor and the electric stepper motor of each of the other swivel thruster assemblies.

7. The submersible remotely operated vehicle of claim 4 further comprising a tether provided with conductors for conducting control signals from a remotely located controller to a control circuit located inside inner hull that communicates with the electric propulsion motor and the electric stepper motor of each swivel thruster assembly whereby the electric propulsion motor and the electric stepper motor of each swivel thruster assembly is controlled independent of the electric propulsion motor and the electric stepper motor of each of the other swivel thruster assemblies.

8. The submersible remotely operated vehicle of claim 5 wherein the remotely located controller is located on either land or a surface vessel.

9. The submersible remotely operated vehicle of claim 6 wherein the remotely located controller is located on either land or a surface vessel.

10. The submersible remotely operated vehicle of claim 7 wherein the remotely located controller is located on either land or a surface vessel.

11. The submersible remotely operated vehicle of claim 5 further comprising a light for emitting light exterior of the outer hull and a camera for obtaining images exterior of the outer hull, the tether further comprising conductors for conducting signals of images from the camera to the remote controller.

12. The submersible remotely operated vehicle of claim 6 further comprising a light for emitting light exterior of the outer hull and a camera for obtaining images exterior of the outer hull, the tether further comprising conductors for conducting signals of images from the camera to the remote controller.

13. The submersible remotely operated vehicle of claim 7 further comprising a light for emitting light exterior of the outer hull and a camera for obtaining images exterior of the outer hull, the tether further comprising conductors for conducting signals of images from the camera to the remote controller.

14. The submersible remotely operated vehicle of claim 11 further comprising a microphone for receiving sounds exterior of the outer hull, the tether further comprising conductors for conducting signals of sounds from the microphone to the remote controller.

15. The submersible remotely operated vehicle of claim 12 further comprising a microphone for receiving sounds exterior of the outer hull, the tether further comprising conductors for conducting signals of sounds from the microphone to the remote controller.

16. The submersible remotely operated vehicle of claim 13 further comprising a microphone for receiving sounds exterior of the outer hull, the tether further comprising conductors for conducting signals of sounds from the microphone to the remote controller.

17. The submersible remotely operated vehicle of claim 14 further comprising a microphone for receiving sounds exterior of the outer hull, the tether further comprising conductors for conducting signals of sounds from the microphone to the remote controller.

18. A submersible remotely operated vehicle comprising:

(a) an outer hull and an inner hull located inside the outer hull, the outer hull having a fore portion and an aft portion, and a starboard side and a port side;

(b) four swivel thruster assemblies fixed to the outer hull, one swivel thruster assembly projecting from the fore portion of the outer hull on the starboard side of the outer hull, one swivel thruster assembly projecting from the fore portion of the outer hull on the port side of the outer hull, one swivel thruster assembly projecting from the aft portion of the outer hull on the starboard side of the outer hull, and one swivel thruster assembly projecting from the aft portion of the outer hull on the port side of the outer hull, and the two swivel thruster assemblies fixed to the fore portion of the outer hull are located at a first height on the outer hull while the two swivel thruster assemblies fixed to the aft portion of the outer hull are located at a second height on the outer hull, the first and second heights being unequal; each swivel thruster assembly comprising an electric propulsion motor with a propulsion motor drive shaft extending from the electric propulsion motor, the propulsion motor drive shaft communicating via right angle gears with a propeller shaft oriented perpendicular to the propulsion motor drive shaft to rotate the propeller shaft with a propeller fixed to the propeller shaft, and an electric stepper motor with a stepper motor drive shaft extending from the stepper motor, the stepper motor drive shaft driving gears that rotate the propeller shaft and propeller around an axis of the propulsion motor drive shaft; and (c) a tether provided with conductors for conducting control signals from a remotely located controller located on either land or a surface vessel to a control circuit located inside inner hull that communicates with the electric propulsion motor and the electric stepper motor of each swivel thruster assembly whereby the electric propulsion motor and the electric stepper motor of each swivel thruster assembly is controlled independent of the electric propulsion motor and the electric stepper motor of each of the other swivel thruster assemblies.

19. The submersible remotely operated vehicle of claim 18 further comprising a light for emitting light exterior of the outer hull, a camera for obtaining images exterior of the outer hull, and a microphone for receiving sounds exterior of the outer hull, the tether further comprising conductors for conducting signals of images from the camera and signals of sounds from the microphone to the remote controller.

20. The submersible remotely operated vehicle of claim 19 wherein the tether extends from the submersible remotely operated vehicle to a remotely operated floating vehicle that relays signals conducted by the tether to and from the submersible remotely operated vehicle to and from the remote controller.

* * * * *